US006296350B1

(12) United States Patent
Cornell et al.

(10) Patent No.: US 6,296,350 B1
(45) Date of Patent: Oct. 2, 2001

(54) INK JET PRINTER HAVING DRIVER CIRCUIT FOR GENERATING WARMING AND FIRING PULSES FOR HEATING ELEMENTS

(75) Inventors: Robert Wilson Cornell; Bruce David Gibson, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 08/823,594

(22) Filed: Mar. 25, 1997

(51) Int. Cl.[7] ..... B41J 2/05
(52) U.S. Cl. ..... 347/60
(58) Field of Search ..... 347/20, 54, 56, 347/60, 12, 10, 11, 14

(56) References Cited

U.S. PATENT DOCUMENTS

| | | | | |
|---|---|---|---|---|
| 4,313,124 | * | 1/1982 | Hara | 347/9 |
| 4,490,728 | | 12/1984 | Vaught et al. . | |
| 4,503,444 | | 3/1985 | Tacklind . | |
| 4,638,337 | | 1/1987 | Torpey et al. . | |
| 4,746,937 | | 5/1988 | Realis Luc et al. . | |
| 4,982,199 | | 1/1991 | Dunn . | |
| 5,036,337 | | 7/1991 | Rezanka . | |
| 5,063,655 | | 11/1991 | Lamey et al. . | |
| 5,107,276 | * | 4/1992 | Kneezel et al. | 347/60 |
| 5,138,333 | | 8/1992 | Bartky et al. . | |
| 5,172,134 | | 12/1992 | Kishida et al. . | |
| 5,285,215 | | 2/1994 | Liker . | |
| 5,300,969 | | 4/1994 | Miura et al. . | |
| 5,420,618 | | 5/1995 | Sekiya et al. . | |
| 5,559,535 | * | 9/1996 | Otsuka et al. | 347/14 |
| 5,657,060 | * | 8/1997 | Sekiya et al. | 347/15 |
| 5,838,340 | * | 11/1998 | Shimoda | 347/14 |
| 5,963,233 | * | 10/1999 | Shirota et al. | 347/60 |

FOREIGN PATENT DOCUMENTS

| | | |
|---|---|---|
| 0 626 261 | 11/1994 | (EP) . |
| 0 694 395 | 1/1996 | (EP) . |
| 0 816 084 | 11/1998 | (EP) . |
| WO90 10541 | 9/1990 | (WO) . |

OTHER PUBLICATIONS

Cornell, R., "A Theoretical and Experimental Examination of Thermal Ink Jet Nucleation Criteria," IS&T'NIP12: International Conference on Digital Printing Technologies, Oct./Nov. 1996, pp. 19–24.

* cited by examiner

*Primary Examiner*—John Barlow
*Assistant Examiner*—Michael S Brooke
(74) *Attorney, Agent, or Firm*—John A. Brady

(57) ABSTRACT

An ink jet printing apparatus is provided comprising a print cartridge including at least one resistive heating element in at least one ink-containing chamber having an orifice. The apparatus further includes a driver circuit, electrically coupled to the print cartridge, for applying to the resistive heating element warming and firing pulses separated by a delay period. The warming pulse causes the resistive heating element to warm a portion of the ink adjacent to the heating element and the firing pulse causes the resistive heating element to produce a vapor bubble in the chamber which causes a droplet of ink to be ejected from the chamber orifice.

64 Claims, 16 Drawing Sheets

INK JET PRINTER HAVING DRIVER CIRCUIT FOR GENERATING WARMING AND FIRING PULSES FOR HEATING ELEMENTS

FIELD OF THE INVENTION

This invention relates to ink jet printers having a driver circuit for applying warming and firing pulses to ink jet printer heating elements.

BACKGROUND OF THE INVENTION

Drop-on-demand ink jet printers use thermal energy to produce a vapor bubble in an ink filled chamber to expel a droplet. A thermal energy generator or heating element, usually a resistor, is located in the chamber near a discharge orifice. A plurality of chambers, each provided with a single heating element, are provided in the printer's printhead. The resistors are individually addressed with an energy pulse to momentarily vaporize the ink and form a bubble which expels an ink droplet. Preferably, each ink droplet travels along a substantially straight-line path as it moves from the orifice to the recording medium, such as paper. The straight-line path is generally perpendicular to the printhead. At times, a small amount of ink collects on the outer surface of the printhead around one or more of the orifices. As the droplets travel out of the orifices, they may be contacted by this excess ink causing them to be diverted from their intended straight-line paths of movement.

It would be desirable to provide an ink jet printer which generates droplets that travel along substantially straight-line paths even if ink collects around the printhead orifices and contacts the ejected droplets.

SUMMARY OF THE INVENTION

The instant invention is directed to an ink jet printing apparatus which applies to each heating element a warming pulse and a firing pulse separated from one another by a delay period. A first quantity of thermal energy is applied to a thin layer of ink located just above the surface of the heating element as a result of the warming pulse. This energy is allowed to diffuse or "soak" into the ink during the delay period. A second quantity of thermal energy is transferred to the ink just above the heating element when a firing pulse is applied to the heating element at the end of the delay period. Assuming that the delay period is not too long or too short, the first and second quantities of thermal energy result in the formation of an ejection bubble having increased momentum. Such a bubble causes the resulting ejected ink droplet to likewise have increased momentum. The increased momentum, however, is due to a significant extent to an increase in velocity rather than droplet mass. The droplets ejected by the printing apparatus of the present invention, because of their increased velocity, are less likely to be diverted from their intended straight-line paths by ink which has collected on the outer surface of the printhead.

DETAILED DESCRIPTION OF THE PREFERRED EMBODIMENT

Figure 1:
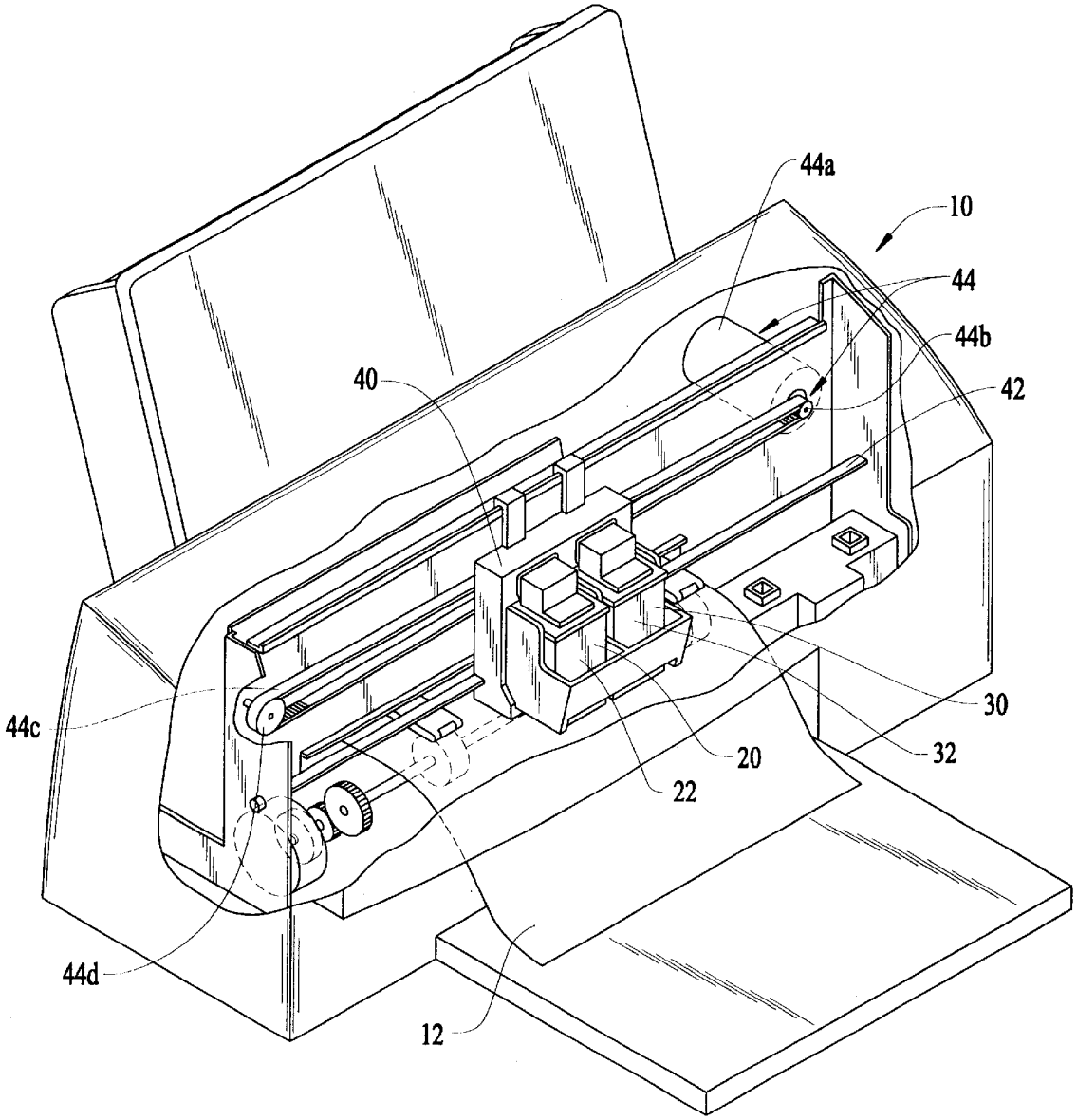
FIG. 1 is a perspective view, partially broken away, of a printing apparatus constructed in accordance with the present invention.

Referring now to FIG. 1, there is shown an ink jet printing apparatus 10 constructed in accordance with the present invention. It includes a first print cartridge 20 for ejecting first droplets and a second print cartridge 30 for ejecting second droplets. The cartridges 20 and 30 are supported in a carrier 40 which, in turn, is slidably supported on a guide rail 42. A drive mechanism 44 is provided for effecting reciprocating movement of the carrier 40 back and forth along the guide rail 42. The drive mechanism 44 includes a motor 44*a* with a drive pulley 44*b* and a drive belt 44*c* which extends about the drive pulley 44*b* and an idler pulley 44*d*. The carrier 40 is fixedly connected to the drive belt 44*c* so as to move with the drive belt 44*c*. Operation of the motor 44*a* effects back and forth movement of the drive belt 44*c* and, hence, back and forth movement of the carrier 40 and the print cartridges 20 and 30. As the print cartridges 20 and 30 move back and forth, they eject ink droplets onto a paper substrate 12 provided below them.

Figure 3:
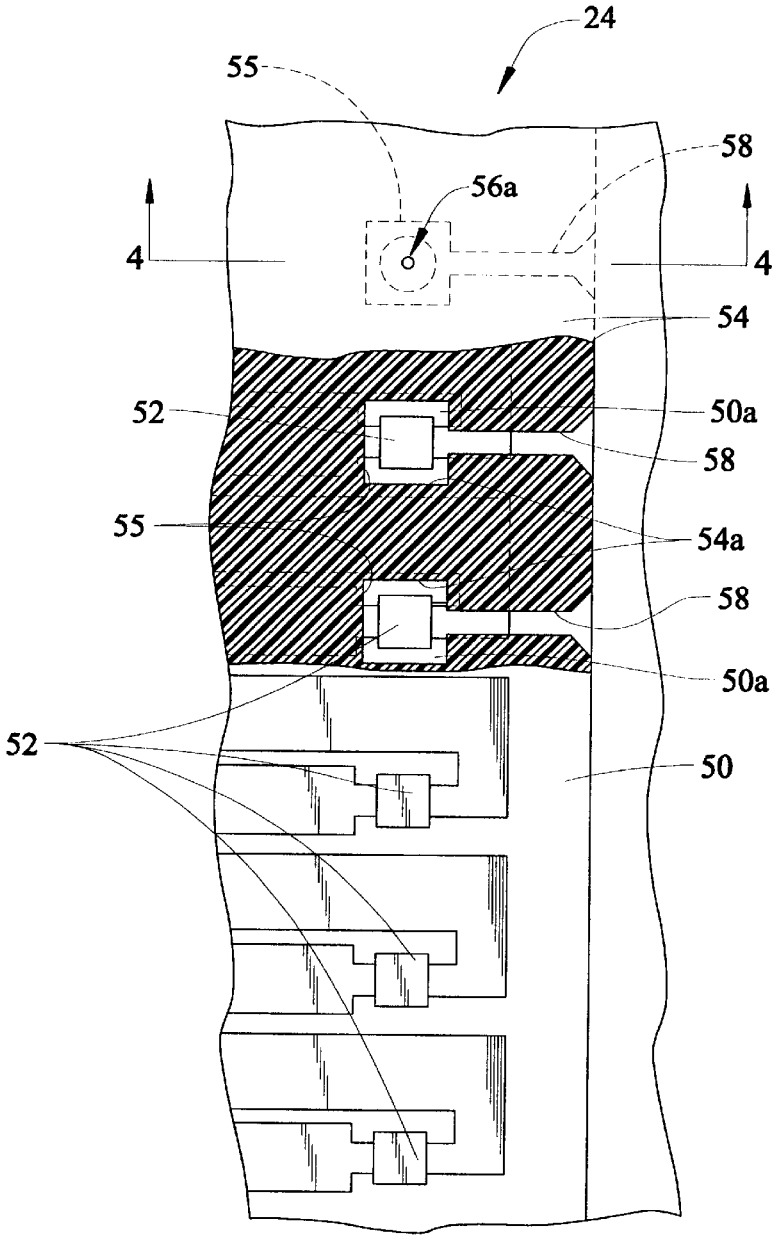
FIG. 3 is a plan view of a portion of a first printhead showing an outer surface of a section of the first plate, another section of the first plate having a portion partially removed, and the surface of a portion of the first heating chip with the section of the first plate above that chip portion completely removed.
Figure 4:
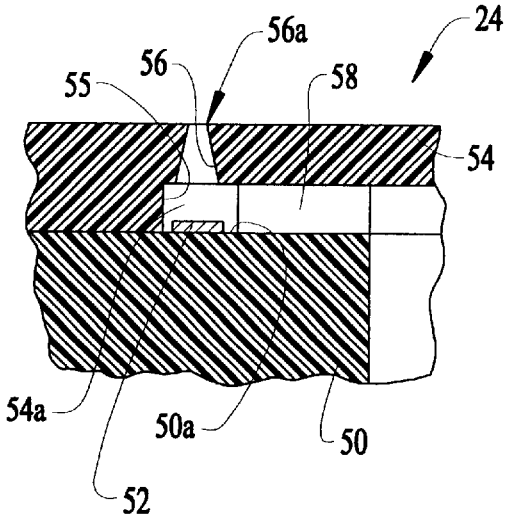
FIG. 4 is a view taken along view line 4—4 in FIG. 3.
Figure 5:
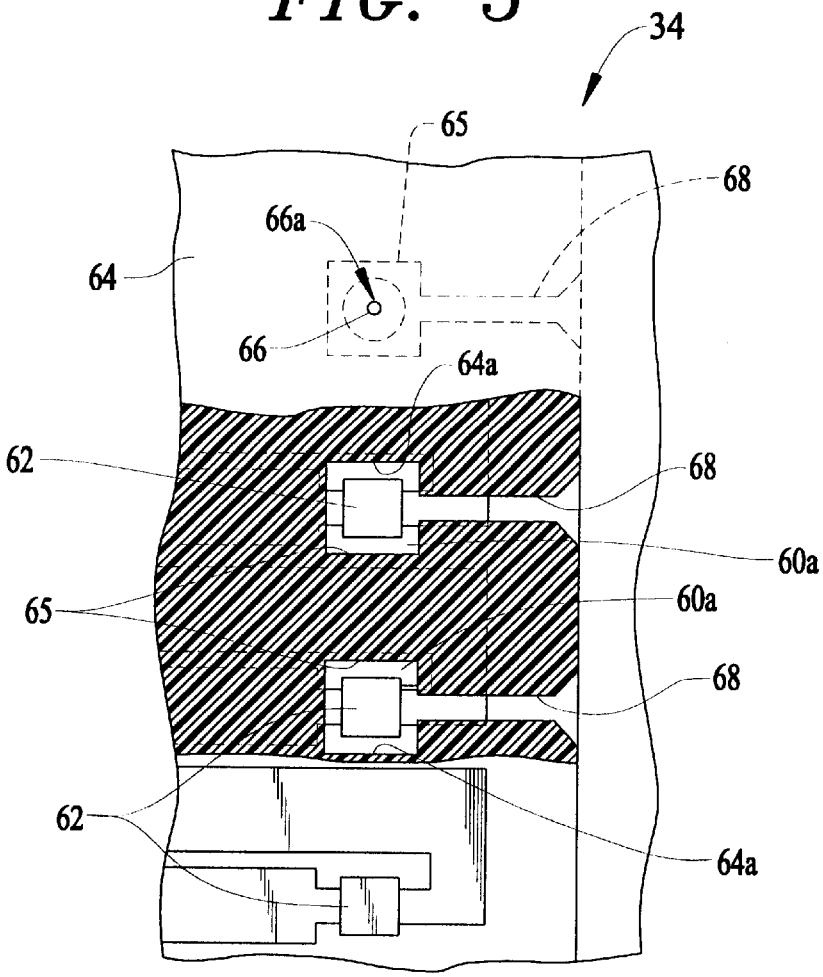
FIG. 5 is a plan view, partially broken away at two different depths, of a portion of a second printhead.

The first print cartridge 20 comprises a first reservoir 22 filled with ink and a first printhead 24, see FIGS. 3 and 4, which is adhesively or otherwise joined to the reservoir 22. The second print cartridge 30 comprises a second reservoir 32 filled with ink and a second printhead 34, see FIG. 5. The first and second reservoirs 22 and 32 preferably comprise polymeric containers. The reservoirs 22 and 32 may be refilled with ink.

The first printhead 24 comprises a first heater chip 50 having a plurality of first resistive heating elements 52. The first printhead 24 further includes a first plate 54 having a plurality of first openings 56 extending through it which define a plurality of first orifices 56*a* through which first droplets of a first size are ejected. In the illustrated embodiment, the first droplets are black.

The first plate 54 may be bonded to the first chip 50 via any art recognized technique, including a thermocompression bonding process. When the first plate 54 and the heater chip 50 are joined together, sections 54*a* of the first plate 54 and portions 50*a* of the first heater chip 50 define a plurality of first bubble chambers 55. Ink supplied by the reservoir 22 flows into the bubble chambers 55 through ink supply channels 58. The first resistive heating elements 52 are positioned on the heater chip 50 such that each bubble chamber 55 has only one first heating element 52. Each bubble chamber 55 communicates with one first orifice 56*a*, see FIG. 4.

The second printhead 34 comprises a second heater chip 60 having a plurality of second resistive heating elements 62. The second printhead 34 further includes a second plate 64 having a plurality of second openings 66 extending through it which define a plurality of second orifices 66*a*. In the illustrated embodiment, second color droplets of either cyan, magenta or yellow ink are ejected through the second orifices 66*a*. The second droplets have a second size which is generally less than that of the first droplets. It is also contemplated that the first and second droplets may be of the same size.

The second plate 64 may be bonded to the second chip 60 in the same manner that the first plate 54 is bonded to the first chip 50. When the second plate 64 and the second heater chip 60 are joined together, sections 64*a* of the second plate 64 and portions 60*a* of the second heater chip 60 define a plurality of second bubble chambers 65, see FIG. 5. The cyan, magenta and yellow inks supplied by the reservoir 22, which has separate ink-filled chambers (not shown), flow into the bubble chambers 65 through ink supply channels 68. Each bubble chamber 65 is provided with a single heating element 62 and communicates with a single second orifice 66*a*.

Figure 2:
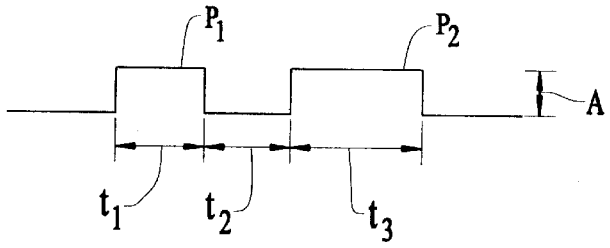
FIG. 2 is a schematic representation of warming and firing pulses applied to a heating element by the driver circuit of the present invention.

In accordance with the present invention, the first and second resistive heating elements 52 and 62 are individually addressed by warming and firing voltage pulses $P_1$ and $P_2$ separated by a delay period $t_2$, see FIG. 2. The warming pulse $P_1$ has a pulse width $t_1$ and a voltage amplitude A and the firing pulse $P_2$ has a pulse width $t_3$ and, in the illustrated embodiment, the same voltage amplitude as the warming pulse $P_1$. As will be discussed more explicitly below, those pulses are provided by a driver circuit 70, see FIG. 15.

During application of a firing pulse to one of the heating elements 52 and 62, the ink-heating element interface temperature climbs at a rate exceeding 100 million ° C. per second. When the ink reaches the superheat limit (about 330° C.), it nucleates, or explodes into vapor. See, Robert Cornell, "A Theoretical and Experimental Examination of Thermal Ink Jet Nucleation Criteria," IS&T's NIP12: International Conference on Digital Printing Technologies (1996), the disclosure of which is incorporated herein by reference. The water vapor in the bubble has low diffusivity, so the ink is substantially thermally disconnected from the heating element once nucleation or bubble growth begins. Hence, once nucleation is initiated, bubble growth is fed by the thermal energy stored in the ink, i.e., the thermal energy transferred by the heating element to the liquid phase of the ink before the vapor phase separates the liquid ink from the surface of the heating element. The function of the bubble is to displace ink within the bubble chamber such that a droplet of ink is expelled from the bubble chamber orifice.

The warming pulse causes a first quantity of thermal energy to be transferred by the heating element to the liquid ink while the firing pulse effects the transfer of a second quantity of thermal energy to the liquid ink. The warming pulse does not result in the ink being heated to its superheat limit. The first quantity of thermal energy is allowed to diffuse or "soak" into the liquid ink during the delay period.

The layer of ink surrounding the heating element into which thermal energy has been transferred by the heating element is defined herein as the "thermal boundary layer." It extends from about 0.1 micron to about 1.5 microns, including all ranges subsumed therein, and preferably from about 0.7 micron to about 1.2 microns into the layer of ink just above the heating element after the warming pulse $P_1$, and from about 2.5 microns to about 4.0 microns, including all ranges subsumed therein, and preferably from about 2.7 microns to about 3.2 microns into the ink after the heating pulse $P_2$. The ink forming the thermal boundary layer has a temperature which exceeds the temperature of the remaining ink in the bubble chamber by more than 0° C. and preferably by about 1.0° C. or more. The temperature of the ink immediately above the heating element just after the warming pulse is greater than about 60° C. and preferably is greater than about 100° C., and more preferably is greater than about 150° C., but is less than 250° C. The temperature of the ink immediately above the heating element just after the delay period is greater than about 100° C., and more preferably is greater than about 120° C.

Figure 6:
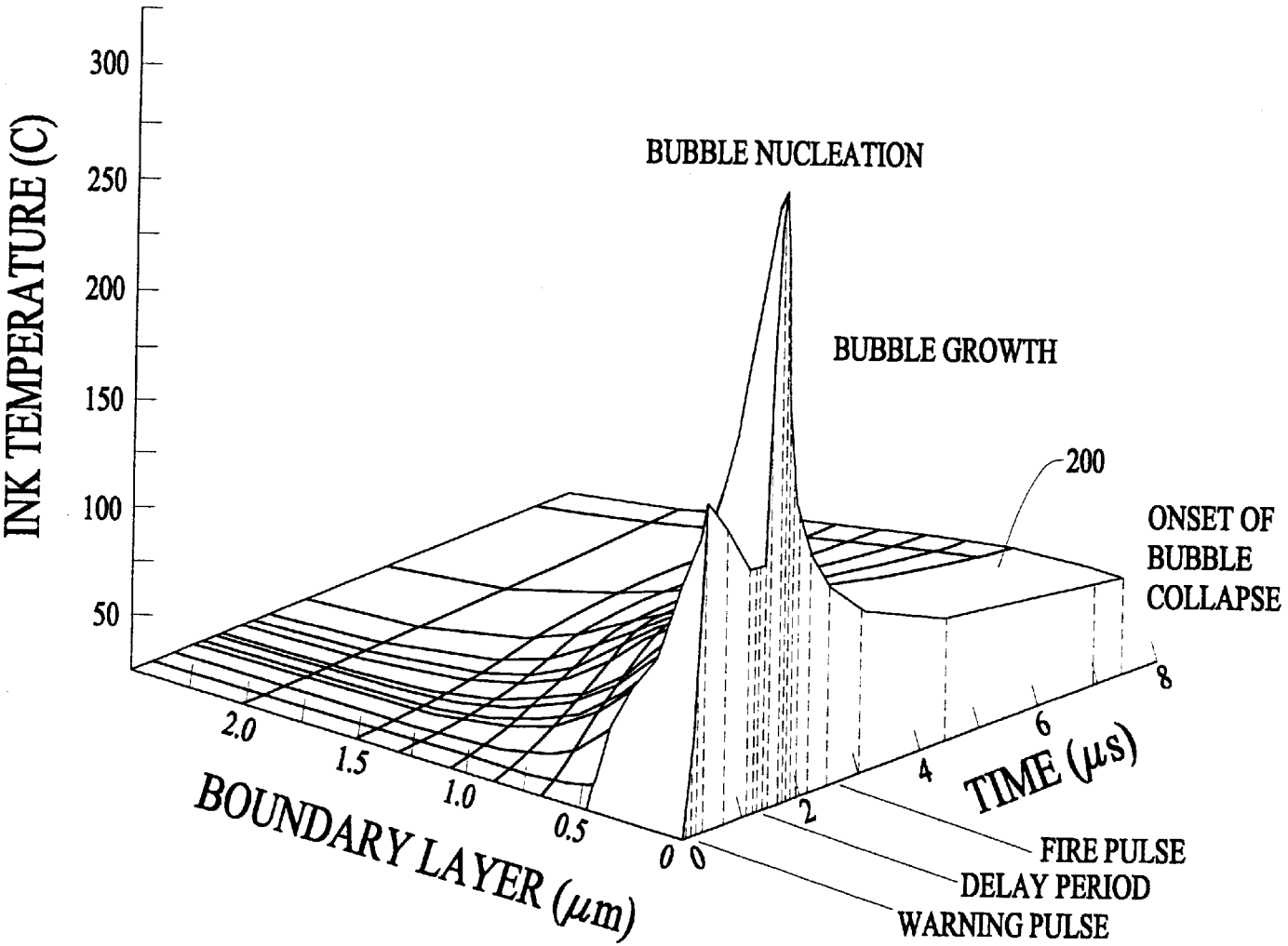
FIGS. 6 and 6A–6C are views of simulation data.
Figure 6A:
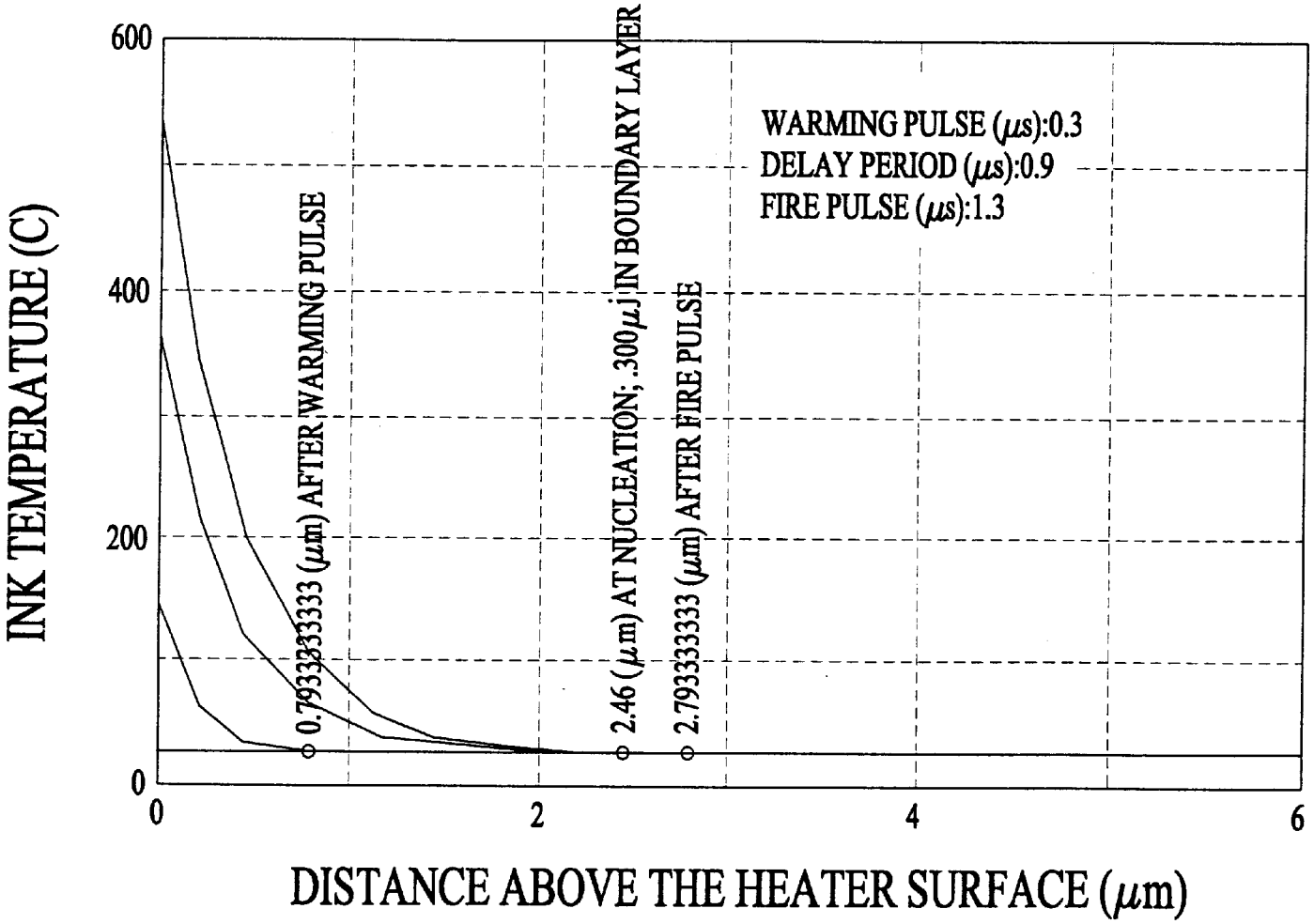

In FIGS. 6 and 6A, illustrative simulation results are shown for a heating element having a resistance of about 28Ω, a width of about 32.5$\mu$ and a length of about 32.5$\mu$ which received a warming pulse $P_1$ having an amplitude of about 11.75 V and a pulse width $t_1$ equal to about 0.3 $\mu$s, and a firing pulse $P_2$ having an amplitude of about 11.75 V and a pulse width $t_3$ equal to about 1.3 $\mu$s separated from the warming pulse $P_1$ by a delay period $t_2$ equal to about 0.9 $\mu$s. As can be seen from FIGS. 6 and 6A, the thermal boundary layer 200 extended about 0.8 micron in the Y-direction above the surface of the heating element after the warming pulse $P_1$ and about 2.8 microns above the heating element after the firing pulse $P_2$. During the delay period, the interface between the ink and the heating element cools while the thermal energy generated as a result of the warming pulse diffuses into the ink. This diffused energy combines with the thermal energy generated by the firing pulse to increase the size of the thermal boundary layer prior to nucleation.

Figure 6B:
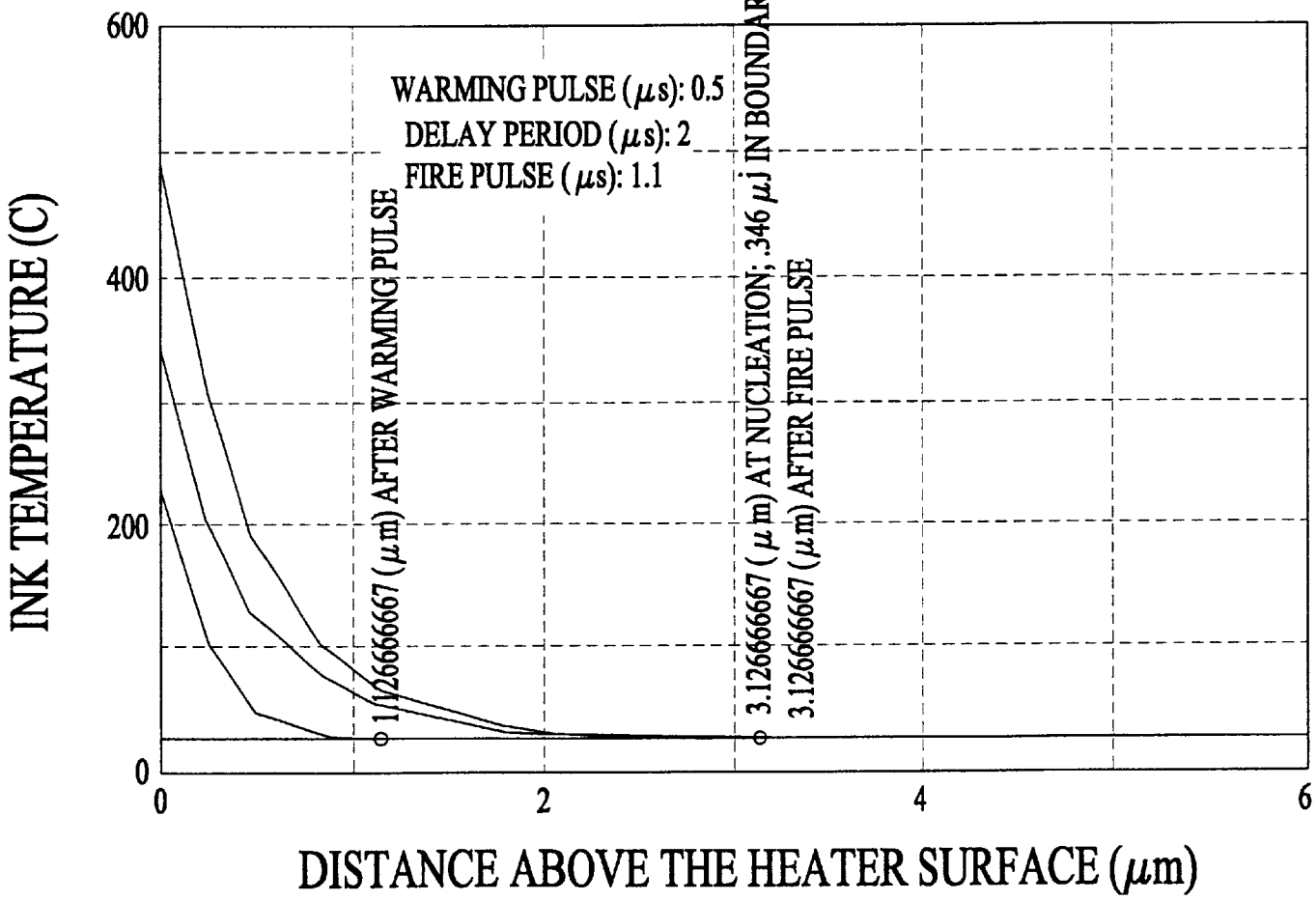

In FIG. 6B, illustrative simulation results are shown for a heating element having a resistance of about 28Ω, a width of about 32.5$\mu$ and a length of about 32.5$\mu$ which received a warming pulse $P_1$ having an amplitude of about 11.75 V and a pulse width $t_1$ equal to about 0.5 $\mu$s, and a firing pulse $P_2$ having an amplitude of about 11.75 V and a pulse width $t_3$ equal to about 1.1 $\mu$s separated from the warming pulse $P_1$ by a delay period $t_2$ equal to about 2.0 $\mu$s. As can be seen from FIG. 6B, the thermal boundary layer extended about 1.1 microns in the Y-direction above the surface of the heating element after the warming pulse $P_1$ and about 3.1 microns above the heating element after the firing pulse $P_2$.

Figure 6C:
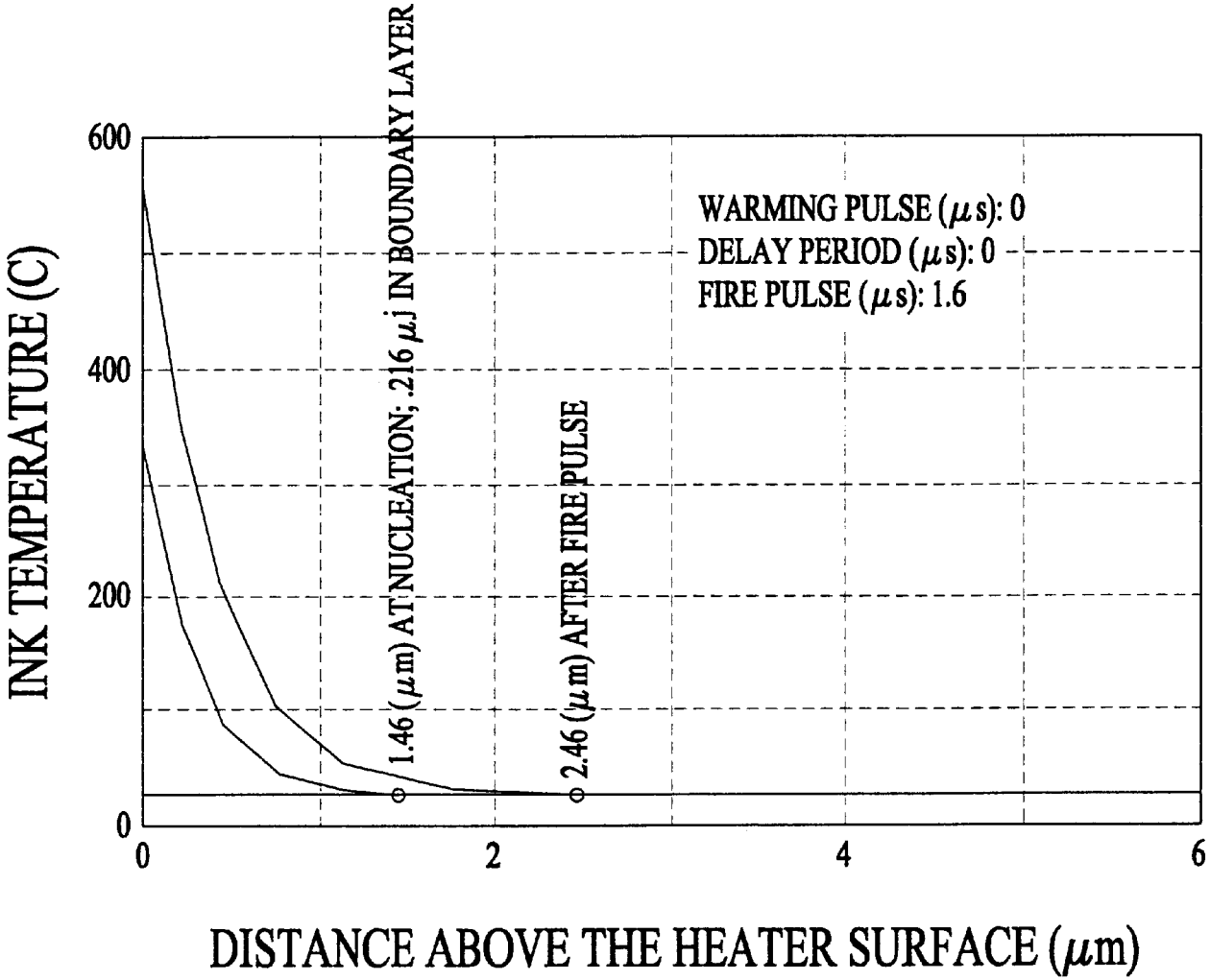

In FIG. 6C, illustrative simulation results are shown for a heating element having the same resistance and dimensions as the heating elements in the FIG. 6A and FIG. 6B examples. It received a firing pulse having an amplitude of about 11.75 V and a pulse width of about 1.6 $\mu$s. Hence, a warming pulse and a delay period were not provided. In this example, the thermal boundary layer extended only 2.46 microns above the surface of the heating element after the firing pulse. Further, only 0.216 $\mu$J of energy had been transferred to the thermal boundary at the time of nucleation as compared to 0.300 $\mu$J of energy in the FIG. 6A example and 0.346 $\mu$J of energy in the FIG. 6B example. While the total amount of energy delivered to the heating element is the same as in the FIG. 6A and FIG. 6B examples, it is evident that splitting the firing pulse into at least two pulses increases the thermal efficiency of the printhead.

Ink in the bubble chamber which does not form part of the thermal boundary layer preferably has a temperature which is from about 20° C. to about 50° C., and most preferably is greater than about 25° C. but less than about 50° C. The temperature of the ink beyond the thermal boundary layer and in the ink supply channels 58 and 68 may be controlled by adjusting the temperature of the heater chips 50 and 60 via substrate heaters, as disclosed in patent application, U.S. Ser. No. 08/528,487, now U.S. Pat. No. 5,734,392 entitled "INK JET PRINTHEAD HEATING," the disclosure of which is hereby incorporated by reference. After the warming pulse $P_1$ has been applied, the thermal boundary layer preferably fills more than 0% and less than 10%, and preferably between about 3% to about 5% of the volume of the bubble chamber, and is located directly above the heating element and below the bubble chamber orifice. Just before nucleation, the thermal boundary layer preferably fills more than 10% and less than 20%, and preferably between about 10% to about 15% of the volume of the bubble chamber, and is located directly above the heating element and below the bubble chamber orifice.

Assuming that the delay period is not too long or too short, the warming pulse results in an increase in the amount of thermal energy stored in the ink prior to nucleation, i.e., an increase in the size of the thermal boundary layer 200. This increase in stored thermal energy corresponds to an increase in the amount of fuel available to power the growth of the ejection bubble. Thermal energy stored in the thermal boundary layer at the time of nucleation was 0.300 $\mu$J in the FIG. 6A example, 0.346 $\mu$J in the FIG. 6B example and 0.216 $\mu$J in the FIG. 6C example. Clearly, stored energy increased when a warming pulse and a delay period were used as demonstrated by these results.

Hence, the resulting ejection bubble has increased momentum. This has been shown by taking simulated acoustic impulse data and multiplying that data (i.e., acoustic impulse) by the area of the heating element that participates in the nucleation process. From this data, it has been shown that bubble momentum is increased when warming and firing pulses $P_1$ and $P_2$, separated by a delay period, are applied to a heating element when compared to the momentum of a bubble resulting when the resistive heating element receives a single firing pulse which applies an energy amount substantially equal to the combined energy amount of the warming and firing pulses $P_1$ and $P_2$.

A bubble having increased momentum results in an ejected ink droplet having increased momentum. As will be evident from the examples below, the increase in droplet momentum is due to a significant extent to an increase in droplet velocity rather than droplet mass.

The delay period is preferably from about 0.5 $\mu$s to about 2.0 $\mu$s. If the delay period is too short, the ink-heating element interface temperature will remain relatively high during application of the firing pulse to the heating element. As a result, nucleation will occur during the early part of the firing pulse, thereby decreasing the amount of time thermal energy may be transferred by the heating element to the liquid ink before the vapor phase separates the liquid ink from the surface of the heating element. If the delay period is too long, the thermal energy transferred to the liquid ink during the application of the warming pulse to the heating element will diffuse into the ink located away from the heating element or into the structure of the printhead. An acceptable balance is believed to exist between ink-heating element interface temperature and thermal diffusion when the delay period is from about 0.5 $\mu$s to about 2.0 $\mu$s.

The following examples are being provided for illustrative purposes only and are not intended to be limiting.

EXAMPLE 1

A 600 dots per inch (DPI) mono, i.e., black aqueous-based ink, printing apparatus was used. Data was taken with and without a delay period being provided. When only firing pulses were applied to the heating elements, each firing pulse had a pulse width of 1.6 $\mu$s and an amplitude of about 11.75 V. When warming and firing pulses were applied, each warming pulse had a pulse width of about 0.3 $\mu$s and an amplitude of about 11.75 V, each firing pulse had a pulse width of about 1.3 $\mu$s and an amplitude of about 11.75 V, and the delay period was 0.9 $\mu$s.

Figure 7:
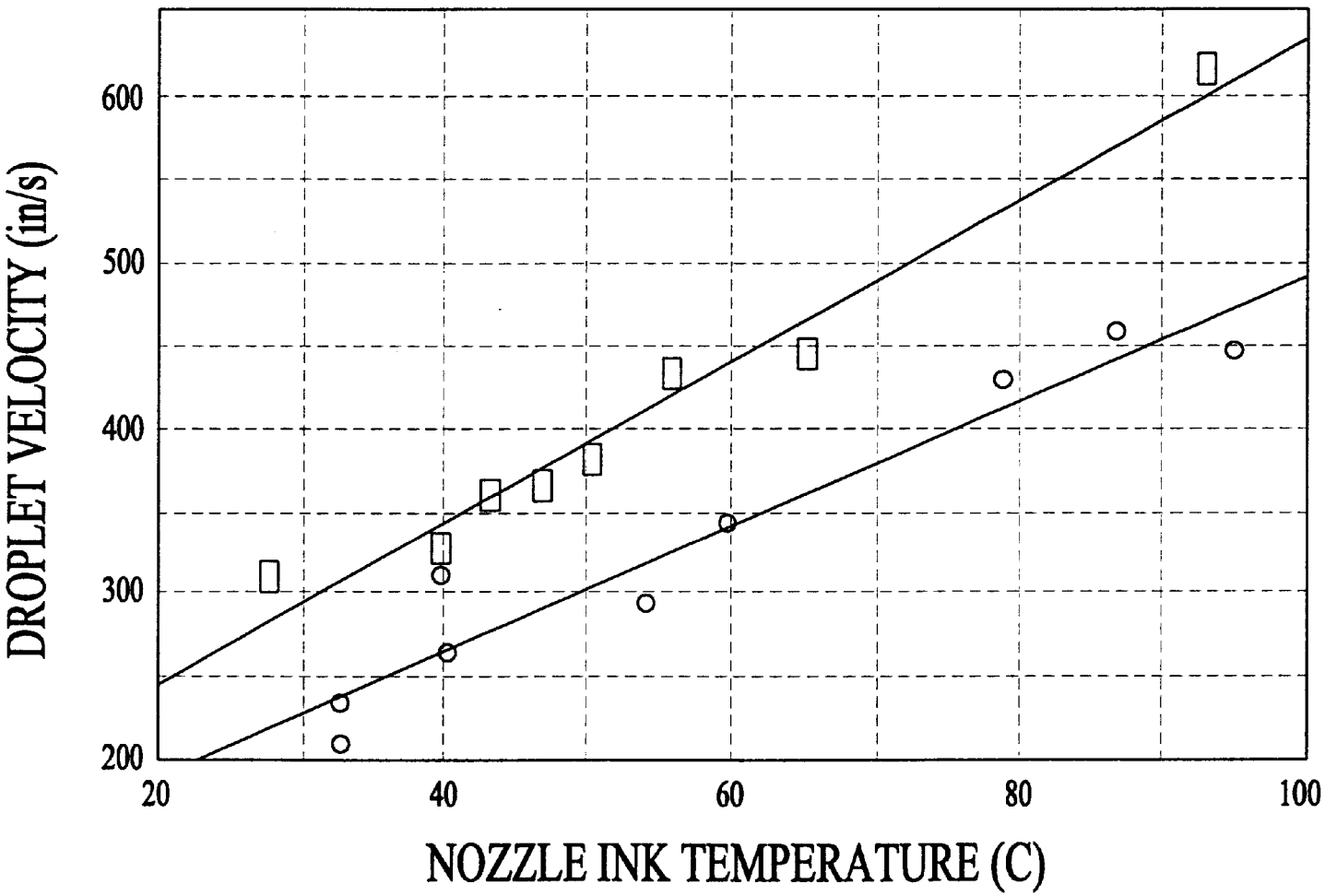
FIGS. 7–14 are views of data plots.
Figure 8:
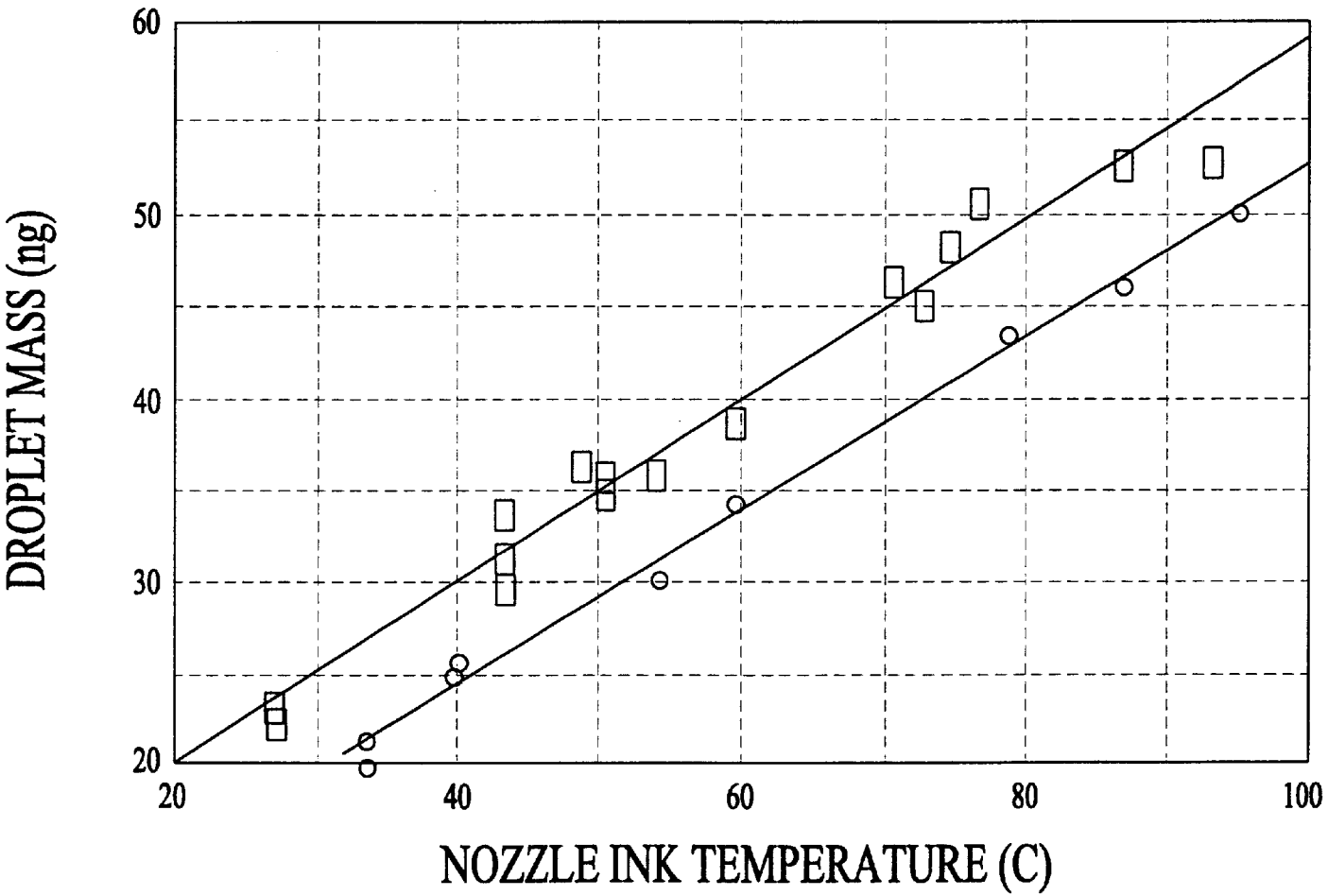

In FIG. 7, droplet velocity vs. nozzle ink temperature is lotted and in FIG. 8, droplet mass vs. nozzle ink temperature is plotted. A delay period was provided when the rectangular data points were collected and no delay period was provided when the circular data points were collected. Nozzle ink temperature is the temperature of the ink flowing into and filling the bubble chamber. It is apparent from this data that, with or without a delay period, droplet velocity and droplet mass increase as nozzle ink temperature increases. This occurs because the viscosity of the ink in the bubble chamber decreases as its temperature increases.

Figure 9:
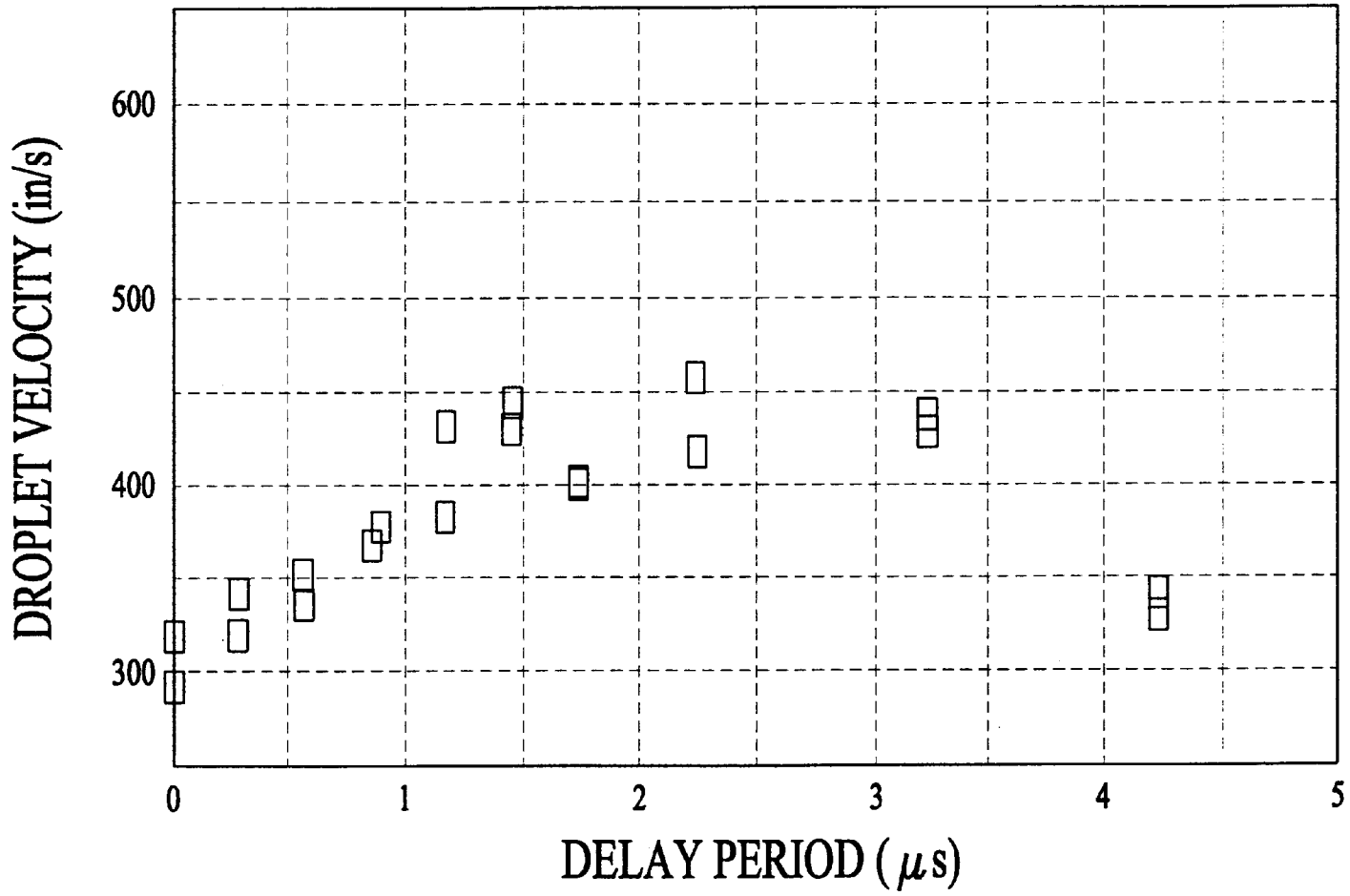
Figure 10:
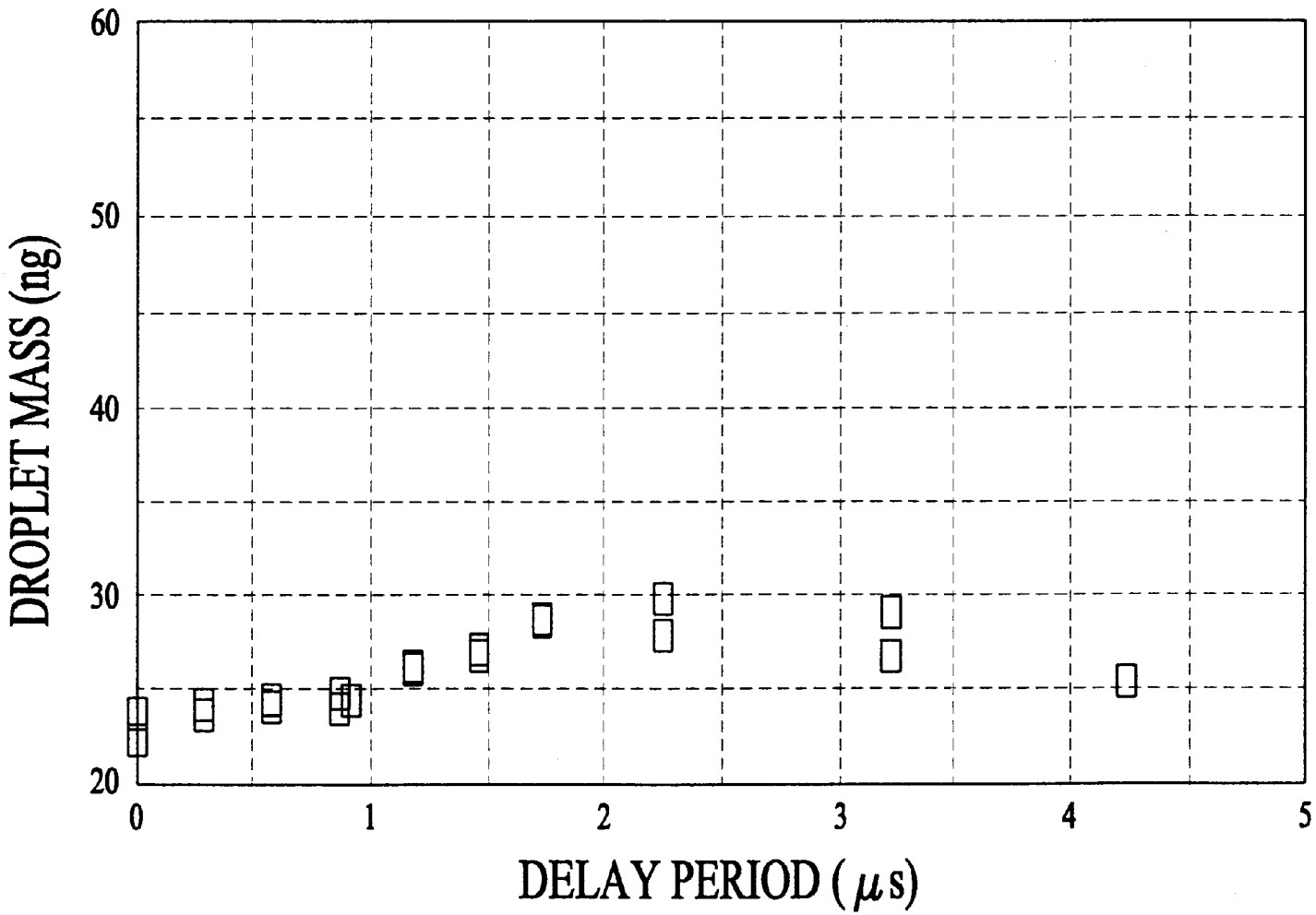

In FIG. 9, droplet velocity vs. delay period is plotted and in FIG. 10, droplet mass vs. delay period is plotted. The data plotted in FIGS. 9 and 10 was taken when a warming pulse $P_1$ having an amplitude of about 11.75 V and a pulse width $t_1$ equal to about 0.3 $\mu$s, and a firing pulse $P_2$ having an amplitude of about 11.75 V and a pulse width $t_3$ equal to about 1.3 $\mu$s were applied to the heating elements. The combined energy of one warming pulse $P_1$ and one firing pulse $P_2$ equaled the total amount of energy supplied by the single 1.6 $\mu$s firing pulse noted above. Nozzle ink temperature was approximately 28° C. As can be seen from FIG. 9, droplet velocity increased above about 420 inch/s when a delay period greater than about 1 $\mu$s was used. Droplet velocity was about 310 inch/s when a 0 delay period was used and a 1.6 $\mu$s firing pulse was applied. Thus, when a delay period was used, droplet velocity increased by about 36%, as determined by the following equation:

$$\%\ \text{change in velocity}=((V_{DP}-V_0)/V_0)\times 100$$

where $V_{DP}$=velocity with a non-zero delay period $V_0$=velocity with a zero delay period Mass also increased when the delay period exceeded about 1 $\mu$s. The increase was slight as droplet mass stayed below about 28.0 ng. Droplet mass was about 23.0 ng when a 0 delay period was used and a 1.6 $\mu$s firing pulse was applied. Thus, droplet mass increased by about 22%, as determined by the following equation:

$$\%\ \text{change in mass}\ ((M_{DP}-M_0)/M_0)\times 100$$

where $M_{DP}$=mass with a non-zero delay period $M_0$=mass with a zero delay period In order to achieve a droplet velocity of about 420 inch/s without a delay period, nozzle ink temperature must be raised to about 80° C., see FIG. 7. At that temperature, droplet mass is approximately 43.0 ng, see FIG. 8. When a delay period of about 1.2 $\mu$s is used, a similar droplet velocity can be attained (i.e., about 420 inch/s), but droplet mass is much smaller, i.e., about 26 ng, see FIGS. 9 and 10.

EXAMPLE 2

A 600 dots per inch (DPI) color printing apparatus was used. Data was taken with and without a delay period being provided. When only firing pulses were applied to the heating elements, each firing pulse had a pulse width of 1.6 $\mu$s and an amplitude of about 11.75 V. When warming and firing pulses were applied, each warming pulse had a pulse width of about 0.3 $\mu$s and an amplitude of about 11.75 V, each firing pulse had a pulse width of about 1.3 $\mu$s and an amplitude of about 11.75 V, and the delay period was 0.9 $\mu$s.

Figure 11:
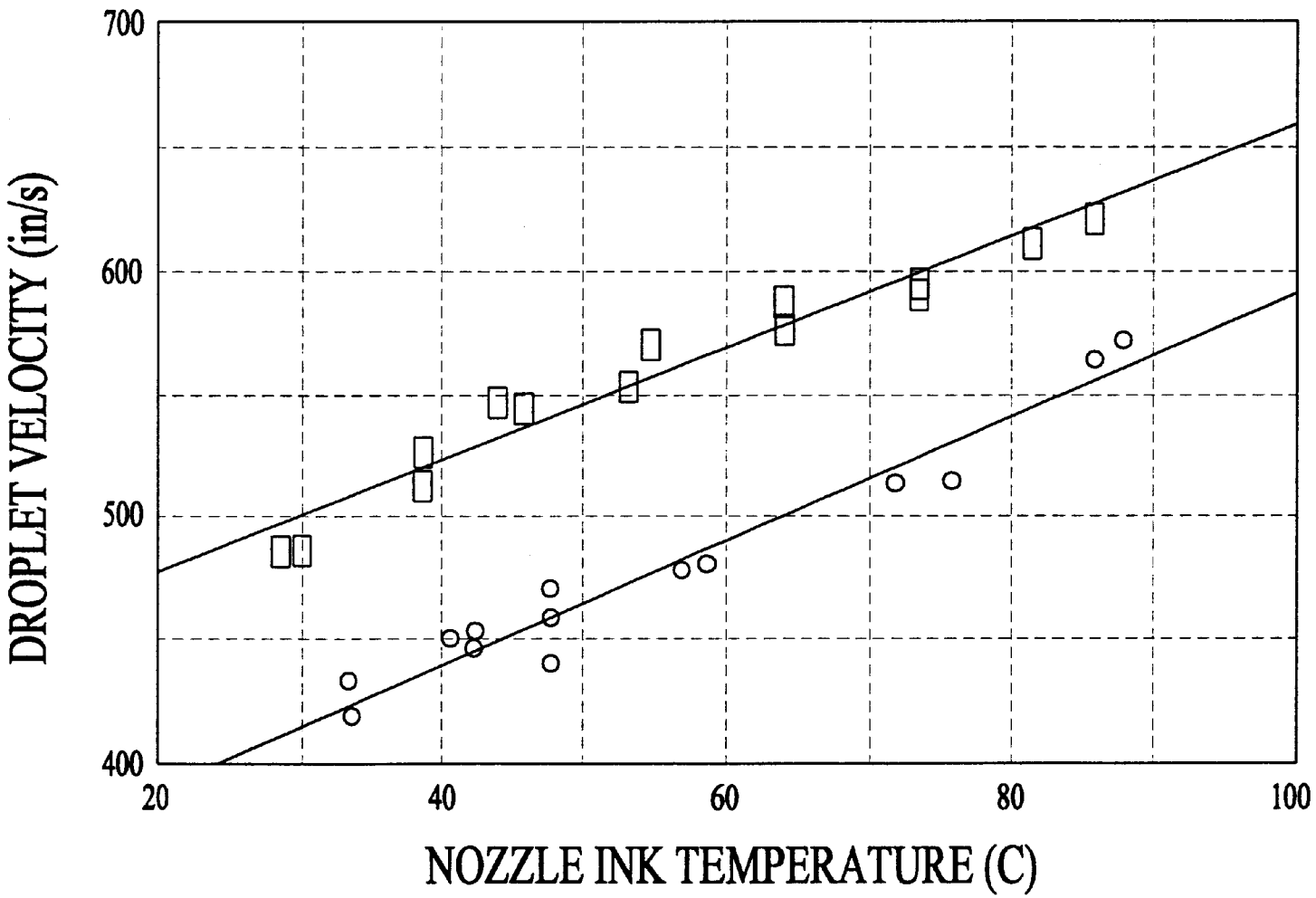
Figure 12:
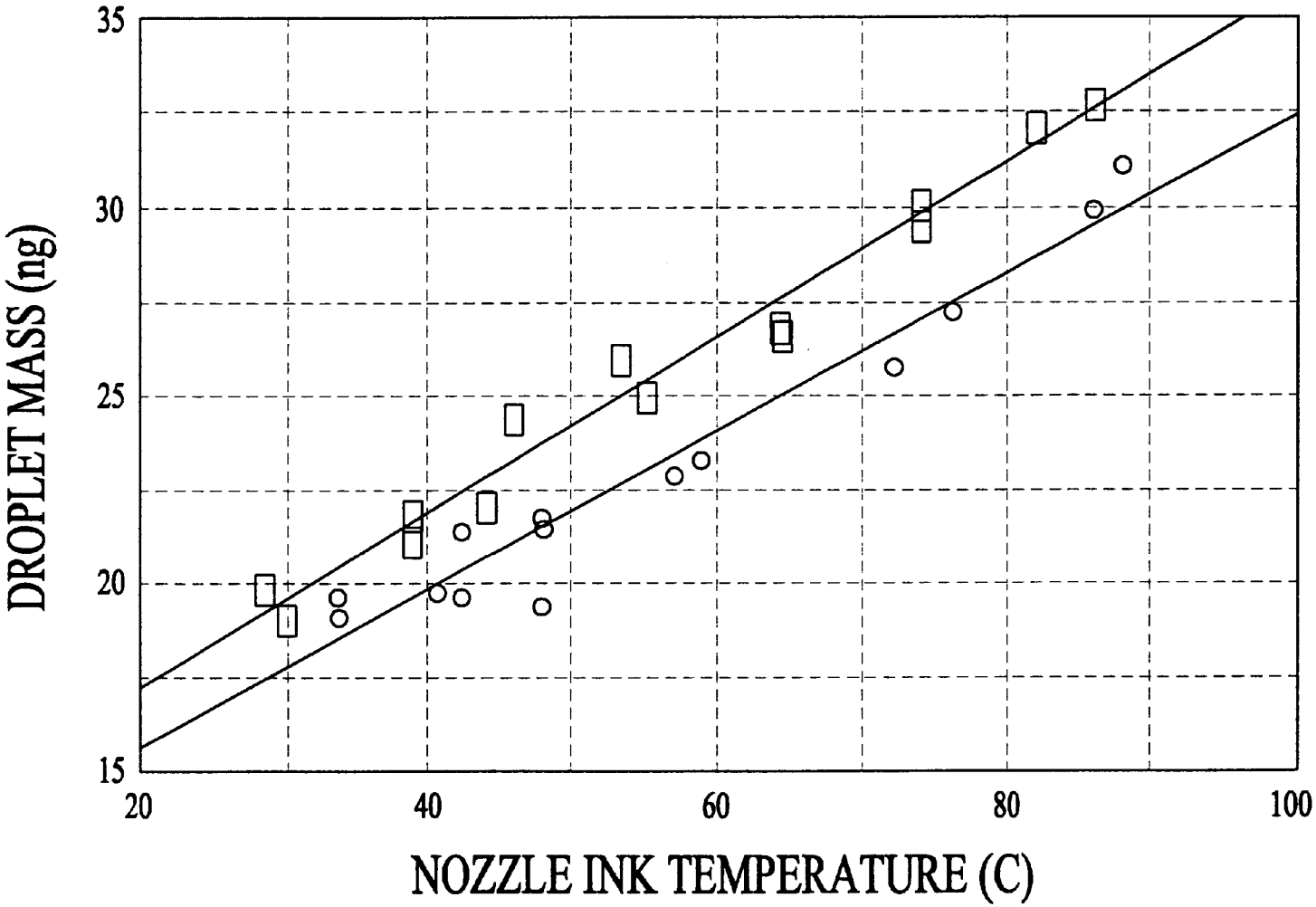

In FIG. 11, droplet velocity vs. nozzle ink temperature is plotted and in FIG. 12, droplet mass vs. nozzle ink temperature is plotted. A delay period was provided when the rectangular data points were collected and no delay period was provided when the circular data points were collected. It is apparent from this data that, with or without a delay period, droplet velocity and droplet mass increase as nozzle ink temperature increases.

Figure 13:
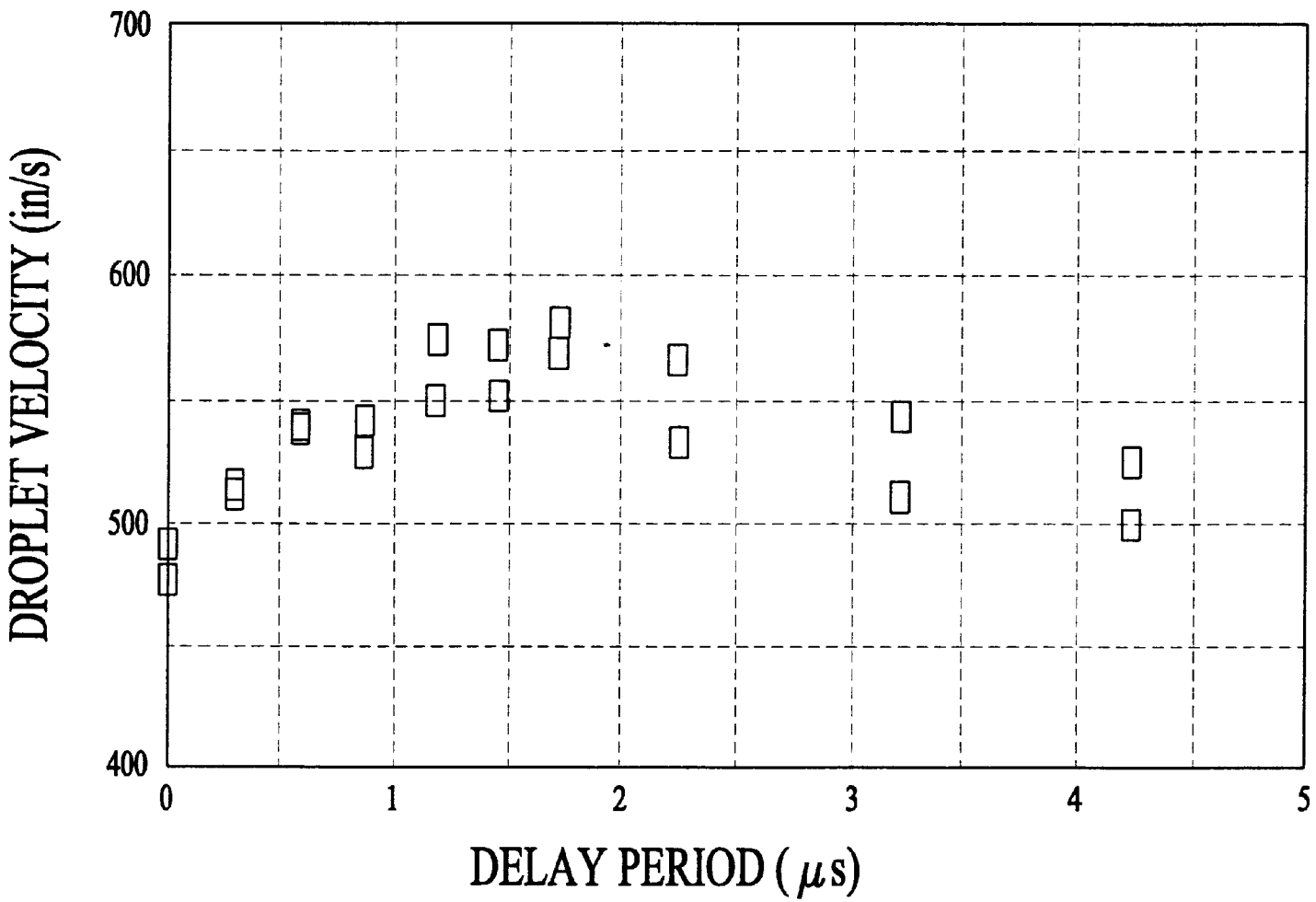
Figure 14:
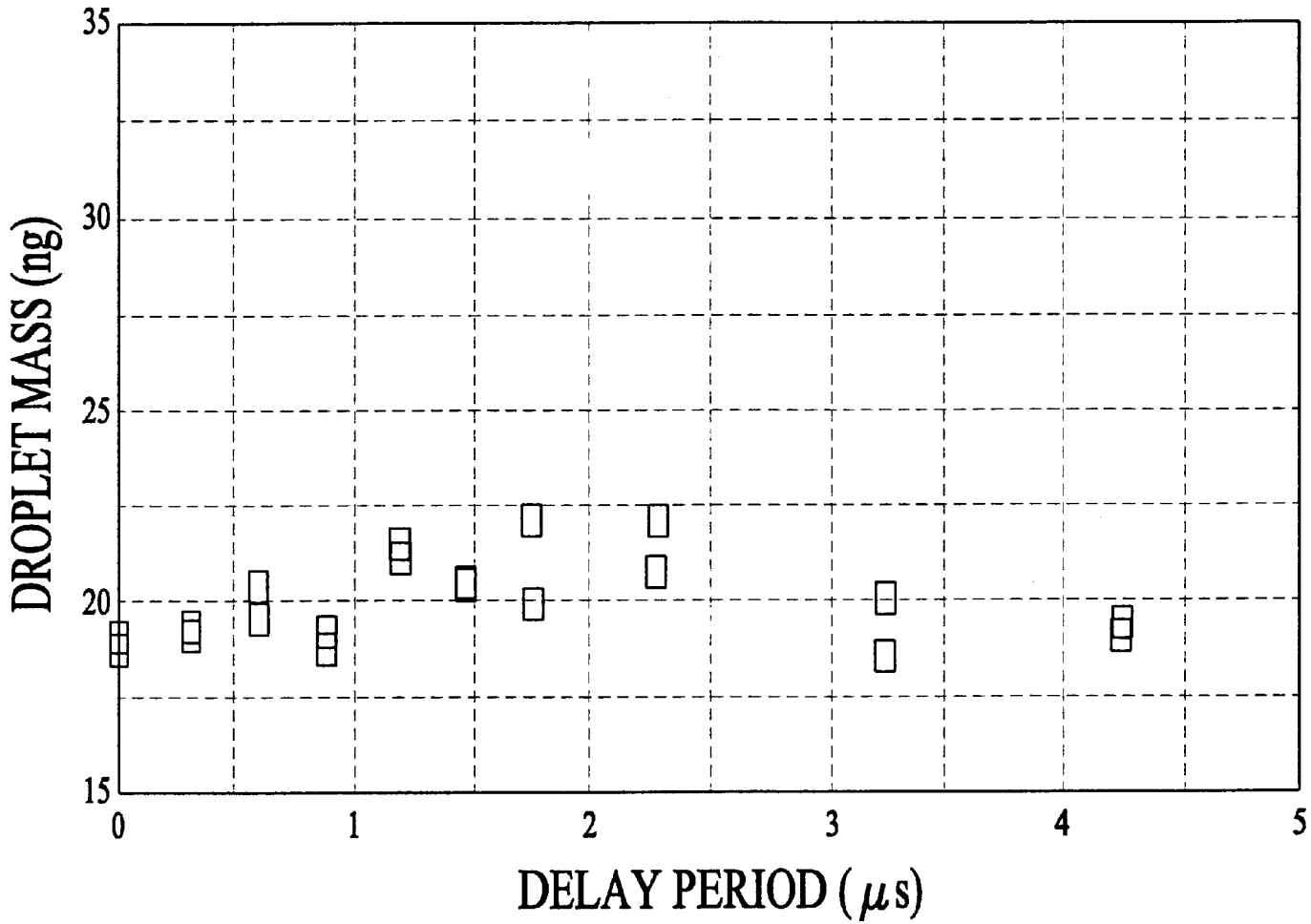

In FIG. 13, droplet velocity vs. delay period is plotted and in FIG. 14, droplet mass vs. delay period is plotted. The data plotted in FIGS. 13 and 14 was taken when a warming pulse $P_1$ having an amplitude of about 11.75 V and a pulse width $t_1$ equal to about 0.3 μs, and a firing pulse $P_2$ having an amplitude of about 11.75 V and a pulse width $t_3$ equal to about 1.3 μs were applied to the heating elements. The combined energy of one warming pulse $P_1$ and one firing pulse $P_2$ equaled the total amount of energy supplied by the single 1.6 μs firing pulse noted above. Nozzle ink temperature was approximately 28° C. As can be seen from FIG. 13, droplet velocity was equal to or exceeded about 550 inch/s when a delay period between about 1 μs and 2 μs was used. Droplet velocity was about 475 inch/s when a 0 delay period was used. Thus, droplet velocity increased by about 16% when a delay period was used. Droplet mass also increased when the delay period was between about 1 μs and 2 μs. It was equal to or less than about 22.0 ng. Droplet mass was about 18 ng when a 0 delay period was used. Thus, droplet mass increased by about 22% when a delay period was used.

Comparing the data in FIGS. 11 and 12 with the data in FIGS. 13 and 14, it is clear that in order to get a droplet velocity of about 550 inch/s without a delay period, nozzle ink temperature must be raised to about 83.0° C. At that temperature, droplet mass is approximately 28.0 ng. When a delay period of between about 1.0 μs and 2.0 μs is used, a similar droplet velocity can be attained, but the droplet mass is much less, i.e., less than about 22.0 ng.

Accordingly, with the present invention, an increase in droplet velocity can be attained without a significant increase in droplet mass occurring. This is advantageous because print it quality is largely dependent on spot size and spot size is dependent on droplet mass. A substantial increase in droplet mass resulting from increased nozzle ink temperature would degrade the imaging capability of the device. Additionally, it is undesirable to substantially heat the entire volume of ink flowing into the bubble chamber to effect increased velocity. When the nozzle ink temperature raises significantly above the reservoir ink temperature, dissolved air will come out of solution and may prevent high speed jetting by accumulating air pockets in the bubble chamber. As a result of the increase in droplet velocity, the ink droplets are less likely to be diverted from their intended straight-line paths by ink which has collected on the outer surface of the printhead.

When the delay period $t_2$ is from about 0.5 μs to about 2.0 μs, the warming pulse width $t_1$ is from about 0.1 μs to about 0.5 μs, the firing pulse width $t_3$ is from about 1.0 μs to about 3.0 μs, the warming pulse voltage amplitude is substantially equal to the firing pulse voltage amplitude, the total energy density applied to each of the first and second heating elements by the combination of the warming pulse $P_1$ and the firing pulse $P_2$ is between about 3000 J/m$^2$ and about 5000 J/m$^2$ and heating element power density is greater than about 2 GW/m$^2$, droplet velocity is increased from about 10% to about 40% and preferably from about 20% to about 40% while droplet mass is increased no more than about 20% to about 25% in comparison to droplets resulting from the same heating elements receiving only a firing pulse (i.e., a single pulse rather than two pulses separated by a delay period) having a pulse width from about 1.5 μs to about 3.0 μs, which firing pulse applies to the heating elements an energy density which is substantially equal to the total energy density applied by the combination of the warming pulse and the firing pulse of the present invention.

$$\text{Heating Element Energy Density} = \frac{\text{Energy Dissipated Across Heating Element}}{\text{Heating Element Length} \times \text{Heating Element Width}}$$

and $$\text{Heating Element Power Density} = \frac{(\text{Heating Element Current})^2 \times \text{Heating Element Resistance}}{\text{Heating Element Length} \times \text{Heating Element Width}}$$

When a delay period is used, resulting droplets have a mass of about 10 ng to about 40 ng and are ejected at a velocity of about 300 inch/s to about 700 inch/s. More specifically, for mono printers, the droplets have a mass of about 20 ng to about 40 ng and are ejected at a velocity of about 300 inch/s to about 600 inch/s and for color printers, the droplets have a mass of about 10 ng to about 25 ng and are ejected at a velocity of about 400 inch/s to about 700 inch/s.

Figure 15:
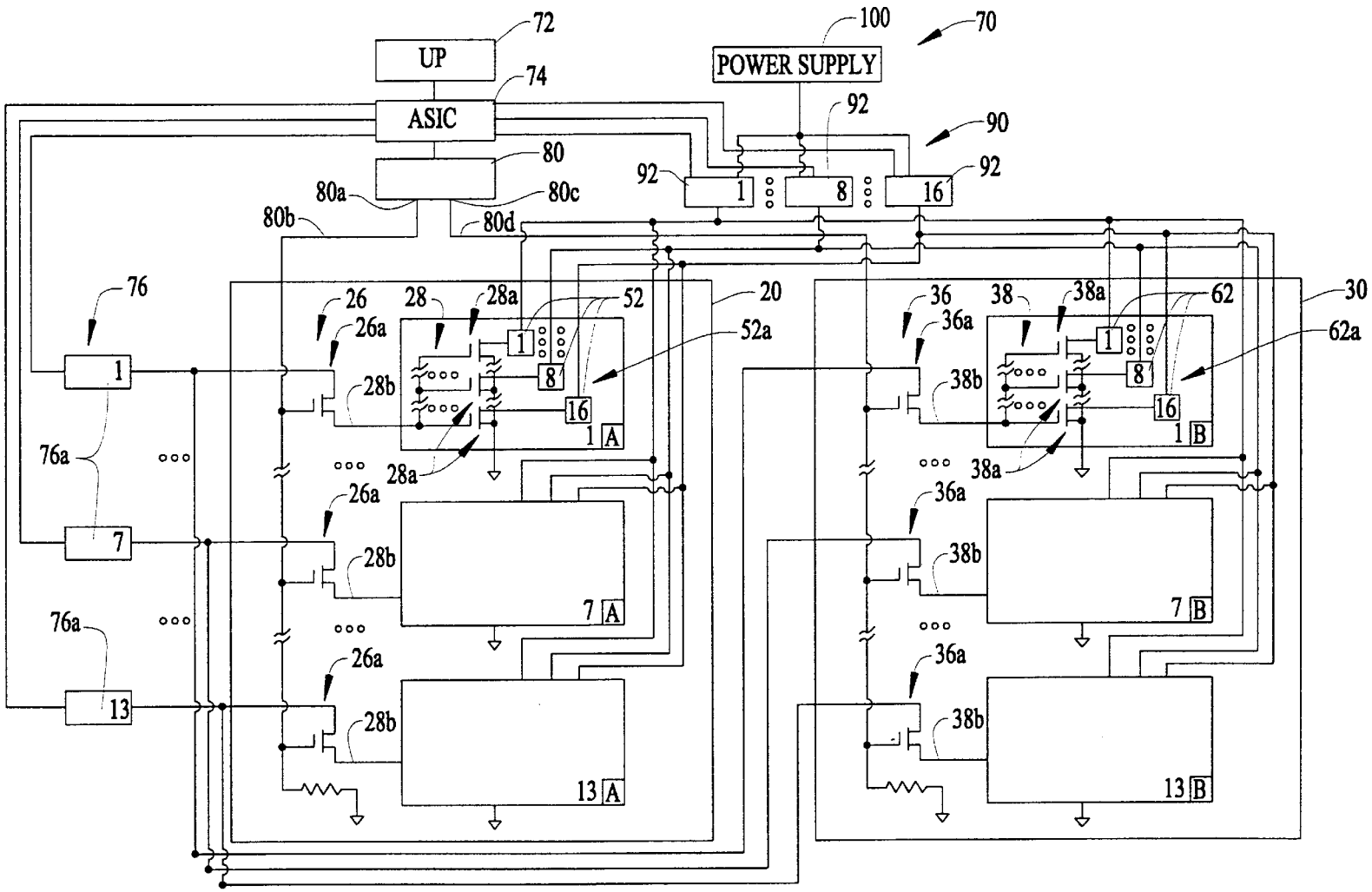
FIG. 15 is a schematic diagram illustrating the driver circuit of the present invention.

The first print cartridge 20 further comprises a first print cartridge enable circuit 26, see FIG. 15. In the illustrated embodiment, the first enable circuit 26 comprises thirteen first field effect transistors (FETs) 26*a*. Likewise, the second print cartridge 30 further comprises a second print cartridge enable circuit 36 which comprises thirteen second field effect transistors 36*a*.

The driver circuit 70 comprises a microprocessor 72, an application specific integrated circuit (ASIC) 74, a print cartridge select circuit 80 and a common drive circuit 90.

The print cartridge select circuit 80 selectively enables one of the first print cartridge 20 and the second print cartridge 30. It has a first output 80*a* which is electrically coupled to the gates of the first FETs 26*a* via conductor 80*b*. It also has a second output 80*c* which is electrically coupled to the gates of the second FETs 36*a* via a conductor 80*d*. Thus, a first print cartridge select signal present at the first output 80*a* is used to select the operation of the first cartridge 20 while a second print cartridge select signal present at the second output 80*c* is used to select the operation of the second cartridge 30. The print cartridge select circuit 80 is electrically coupled to the ASIC 74 and generates appropriate print cartridge select signals in response to command signals received from the ASIC 74.

The plurality of first resistive heating elements 52 are divided into groups. In the illustrated embodiment, thirteen first groups 52*a*, each having sixteen first heating elements 52, are provided. The plurality of second resistive heating elements 62 are similarly divided into thirteen second groups 62*a*, each having sixteen second heating elements 62.

The common drive circuit 90 comprises a plurality of drivers 92 which are electrically coupled to a power supply 100 and to the plurality of first and second resistive heating elements 52 and 62. In the illustrated embodiment, sixteen drivers 92 are provided. Each of the sixteen drivers 92 is electrically coupled to one of the sixteen first heating elements 52 in each of the thirteen first groups 52*a* and to one of the sixteen second heating elements 62 in each of the thirteen second groups 62*a*. Thus, each of the drivers 92 is coupled to thirteen first heating elements 52 and thirteen second heating elements 62. The drivers 92 may comprise field effect transistors or bipolar transistors.

The first print cartridge 20 further comprises a first heating element drive circuit 28 electrically coupled to the first heating elements 52 and the thirteen first field effect transistors (FETs) 26*a*. In the illustrated embodiment, the first heating element drive circuit 28 comprises thirteen groups of sixteen third field effect transistors (FETs) 28*a*. The FETs 28*a* in each of the thirteen groups are connected at their gates to the source of one of the thirteen first FETs 26*a* via conductors 28*b*, see FIG. 15. The drain of each of the third FETs 28*a* is electrically coupled to one of the first heating elements 52. The source of each of the third FETs 28*a* is connected to ground.

The second print cartridge 30 further comprises a second heating element drive circuit 38 electrically coupled to the second heating elements 62 and the thirteen second field effect transistors (FETs) 36*a*. In the illustrated embodiment, the second heating element drive circuit 38 comprises thirteen groups of sixteen fourth field effect transistors (FETs) 38*a*. The FETs 38*a* in each of the thirteen groups are connected at their gates to the source of one of the thirteen second FETs 36*a* via conductors 38*b*. The drain of each of the fourth FETs 38*a* is electrically coupled to one of the second heating elements 62. The source of each of the fourth FETs 38*a* is connected to ground.

The driver circuit 70 further comprises a resistive heating element group select circuit 76 comprising a plurality of select drivers 76*a*, thirteen in the illustrated embodiment. The thirteen select drivers 76*a* are each connected to the drain of one of the first FETs 26*a* and to the drain of one of the second FETs 36*a*. The ASIC 74 sequentially generates thirteen select signals to the thirteen select drivers 76*a*. Thus, in the illustrated embodiment, only a single select driver 76*a* is activated at any given time.

During a given firing period, only one group, 52*a* of the first heating elements 52 or one group 62*a* of the second heating elements 62 will be enabled at any given time. The specific group that is enabled depends upon which select driver 76*a* has been activated by the ASIC 74 and which print cartridge has been enabled by the print cartridge select circuit 80. Any number, i.e., 0 to 16, of the sixteen heating elements within the selected group may be fired. The specific number fired depends upon print data received by the microprocessor 72 from a separate processor (not shown) electrically coupled to it. The microprocessor 72 generates signals which are passed to the ASIC 74 and, in turn, the ASIC 74 generates appropriate warming and firing signals which are passed to the sixteen drivers 92. The activated drivers 92 then apply warming and firing voltage pulses to the heating elements to which they are coupled. The warming and firing voltage pulses applied to the first heating elements 52 have substantially the same amplitude and pulse width and are separated by substantially the same delay period as those applied to the second heating elements 62.

In the illustrated embodiment, the second heating elements 52 have a generally square shape. They may, however, have a rectangular or other geometric shape and/or may have a resistance which differs from that of the first heating elements as discussed in concurrently filed patent application, U.S. Ser. No. 08/823,634, entitled "INK JET PRINTING APPARATUS HAVING FIRST AND SECOND PRINT CARTRIDGES RECEIVING ENERGY PULSES FROM A COMMON DRIVE CIRCUIT," by Robert W. Cornell et al., the disclosure of which is hereby incorporated by reference.

It is contemplated by the present invention that the printing apparatus may have only a single print cartridge. It is further contemplated that the warming pulse may have a different amplitude A than that of the firing pulse.

What is claimed is:

1. An inkjet printing apparatus comprising:

a print cartridge including at least one resistive heating element in at least one chamber capable of containing ink and having an orifice; and a driver circuit, electrically coupled to said print cartridge, for applying to said resistive heating element a warming pulse and a firing pulse separated from one another by a delay period, said warming pulse applying an amount of energy less than an amount of energy applied by the firing pulse, said warming pulse being capable of causing said resistive heating element to warm a portion of ink provided in the chamber, said warming pulse and said delay period cooperating to form a thermal boundary layer in the ink, and said firing pulse being applied while the thermal boundary layer is in the ink and being capable of causing said resistive heating element to produce a vapor bubble in said chamber which causes a resultant droplet of the ink to be ejected from said chamber orifice with a momentum, wherein energy diffused in said thermal boundary layer cooperates with the energy applied by the firing pulse to increase the size of the thermal boundary layer prior to nucleation an thereby increase the momentum of said resultant droplet when compared with a droplet resulting when said resistive heating element receives a single firing pulse which applies an energy amount substantially equal to a combined energy amount of said warming pulse and said firing pulse.

2. An ink jet printing apparatus as set forth in claim 1, wherein said print cartridge includes a plurality of resistive heating elements and a plurality of ink-containing chambers having a plurality of orifices.

3. An ink jet printing apparatus as set forth in claim 2, wherein said print cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of ink-containing chambers, and said plurality of resistive heating elements are positioned on said heater chip such that each of said ink-containing chambers has one of said heating elements located therein.

4. An ink jet printing apparatus as set forth in claim 3, wherein said print cartridge further comprises a reservoir filled with ink.

5. An ink jet printing apparatus as set forth in claim 4, wherein said reservoir is refillable.

6. An ink jet printing apparatus as set forth in claim 1, wherein said delay period is from about 0.5 $\mu$s to about 2.0 $\mu$s.

7. An ink jet printing apparatus as set forth in claim 1, wherein said warming pulse and said firing pulse result in said at least one resistive heating element receiving an energy density of from about 3000 J/m$^2$ to about 5000 J/m$^2$, and a power density greater than about 2 GW/m$^2$.

8. An ink jet printing apparatus as set forth in claim 7, wherein said warming pulse has a pulse width of from about 0.1 $\mu$s to about 0.5 $\mu$s.

9. An ink jet printing apparatus as set forth in claim 8, wherein said firing pulse has a pulse width of from about 1.0 $\mu$s to about 3.0 $\mu$s.

10. An in jet printing apparatus according to claim 1, wherein said resultant droplet of liquid has a mass of about 10 nanograms to about 40 nanograms and ejects from said chamber orifice at a velocity of about 300 inche/s to about 700 inch/s.

11. An apparatus for generating liquid droplets comprising:

a cartridge including at least one resistive heating element in at least one chamber being capable of containing liquids and having an orifice; and a driver circuit, electrically coupled to said cartridge, for applying to said resistive heating element a warming pulse and a firing pulse separated from one another by a delay period, said warming pulse applying an amount of energy less than an amount of energy applied by the firing pulse, said warming pulse being capable of causing said resistive heating element to warm a portion of liquid provided in the chamber, said warming pulse and said delay period cooperating to form a thermal boundary layer in the liquid, and said firing pulse being applied while the thermal boundary layer is in the liquid and being capable of causing said resistive heating element to produce a vapor bubble in sad chamber which causes a resultant droplet of the liquid to be elected from said chamber orifice with a momentum, wherein energy diffused in said thermal boundary layer cooperates with the energy applied by the firing pulse to increase the size of the thermal boundary layer prior to nucleation and thereby increase the momentum of said resultant droplet when compared with a droplet result when said resistive heating element receives a single firing pulse which applies an energy amount substantially equal to a combined energy amount of said warming pulse and said firing pulse.

12. An apparatus as set forth in claim 11, wherein said cartridge includes a plurality of resistive heating elements and a plurality of liquid-containing chambers having a plurality of orifices.

13. An apparatus as set forth in claim 12, wherein said cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of liquid-containing chambers, and said plurality of resistive heating elements are positioned on said heater chip such that each of said liquid-containing chambers has one of said heating elements located therein.

14. An apparatus for generating liquid droplets according to claim 11, wherein said resultant droplet of liquid has a mass 10 nanograms to about 40 nanograms and ejects from said chamber orifice at a velocity of about 300 inch/s to 700 inch/s.

15. A method of ejecting a droplet of liquid from an orifice of a chamber containing the liquid, said method comprising the steps of:

heating a portion of said liquid in said chamber to a temperature which is below a superheat limit of said liquid by passing a warming pulse trough a resistive heating element;

forming a thermal boundary layer in the liquid; and producing a vapor bubble in said chamber to eject a resultant droplet of the liquid with a momentum from said orifice by passing a firing pulse through said resistive heating element while the thermal boundary layer is in the liquid, energy diffused in said thermal boundary layer cooperating with energy applied by the firing pulse to increase the size of the thermal boundary layer prior to nucleation and thereby increase the momentum of said resultant droplet when compared with a droplet resulting when said resistive heating element receives a single firing pulse which applies an energy amount substantially equal to a combined energy amount of said warming pulse and said firing pulse, and said warming pulse applying an amount of energy less than an amount of the energy applied by the firing pulse.

16. A method as set forth in claim 15, wherein said delay period between said heating and producing steps is from about 0.5 $\mu$s to about 2.0 $\mu$s.

17. A method as set forth in claim 16, wherein said warming and firing pulses generated during said heating and producing steps result in said at least one resistive heating element receiving an energy density of from about 3000 $J/m^2$ to about 5000 $J/m^2$, and a power density greater than 2 $GW/m^2$.

18. A method as set forth in claim 17, wherein said heating step comprises passing a warning pulse having a pulse width of from about 0.1 $\mu$s to about 0.5 $\mu$s through said resistive heating element.

19. A method as set forth in claim 18, wherein said producing step comprises passing a firing pulse having a pulse width of from about 1.0 $\mu$s to about 3.0 $\mu$s through said resistive heating element.

20. A method as set forth in claim 15, further comprising the step of providing a liquid ink.

21. A method as set forth in claim 15, wherein the step of froming a thermal boundary layer in the liquid comprises separating the warming pulse and the firing pulse by a delay period.

22. An ink jet printing apparatus comprising:

a print cartridge including at least one resistive heating element in at least one chamber capable of containing ink, and having an orifice; and a driver circuit, electrically coupled to said print cartridge, for applying to said resistive heating element a warming pulse and a firing pulse separated from one another by a delay period, said warming pulse being capable of causing said resistive heating element to warm a portion of ink provided in the chamber so as to form a thermal boundary layer within said ink and said firing pulse being applied while the thermal boundary layer is in the ink and being capable of causing said resistive heating element to produce a vapor bubble in said chamber which causes a droplet of the ink to be ejected from said chamber orifice, wherein energy diffused in the thermal boundary layer cooperates with energy applied by the firing pulse to increase the size of the thermal boundary Layer prior to nucleation.

23. An ink jet printing apparatus as set forth in claim 22, wherein the temperature of a layer of ink just above said heating element after said warming pulse exceeds about 150° C.

24. An ink jet printing apparatus as set forth in claims 23, wherein the temperature of a layer of ink just above said heating element after said delay period exceeds about 100° C.

25. An ink jet printing apparatus as set forth in claim 24, wherein the temperature of the layer of the ink just above the heating element is greater than about 120° C. after the delay period.

26. An ink jet printing apparatus as set forth in claim 23, wherein the temperature of the layer of the ink just above the heating element is less than 250° C. after applying the warming pulse.

27. An ink jet printing apparatus as set forth in claim 22, wherein the thermal boundary layer extends from about 0.1 micron to about 1.5 microns into a layer of the ink jet above the heating element after the warming pulse has been applied.

28. An ink jet printing apparatus as set forth in claim 27, wherein the thermal boundary layer extends from about 0.7 micron to about 1.2 microns into the layer of the ink just above the heating element after the warming pulse has been applied.

29. An ink jet printing apparatus as set forth in claim 22, wherein the thermal boundary layer extends from about 2.5 microns to about 4.0 microns into a layer of the ink just above the heating element after the heating pulse has been applied.

30. An ink jet printing apparatus as set forth in claim 29, wherein the thermal boundary layer extends from about 2.7 microns to about 3.2 microns into the layer of the ink just above the heating element after the heating pulse has been applied.

31. An ink jet printing apparatus as set forth in claim 22, wherein the ink forming the thermal boundary layer has a temperature which exceeds that of the remaining ink in the chamber by at least about 1.0° C.

32. An ink jet printing apparatus as set forth in claim 22, wherein a layer of the ink just above the heating element has a temperature of greater than about 60° C. after applying the warming pulse.

33. An ink jet printing apparatus as set forth in claim 22, wherein a layer of the ink just above the heating element has a temperature of greater than about 100° C. after applying the warming pulse.

34. An ink jet printing apparatus as set forth in claim 22, wherein the thermal boundary layer occupies less than 10% of the volume of the chamber after the warming pulse has been applied.

35. An ink jet printing apparatus as set forth in claim 34, wherein the chamber has a volume and the thermal boundary layer occupies about 3% to about 5% of the volume of the chamber after the warming pulse has been applied.

36. An ink jet printing apparatus as set forth in claim 22, wherein the thermal boundary layer is located above the heating element and below the chamber orifice.

37. An ink jet printing apparatus as set forth in claim 22, wherein the chamber has a volume and the thermal boundary layer fills between about 10% to 20% of the volume of the chamber before nucleation.

38. An ink jet printing apparatus as set forth in claim 37, wherein the thermal boundary layer occupies between about 10% to about 15% of the volume of the chamber before nucleation.

39. An apparatus for generating liquid droplets having a single color comprising:

a cartridge including at least one resistive heating element in at least one chamber capable of containing liquids and having an orifice; and a driver circuit for applying to said resistive heating element a warming pulse and a firing pulse separated from one another by a delay period, said warming pulse being capable of causing said resistive heating element to warm a portion of liquid provided in the chamber, said warming pulse and said delay period cooperating to form a thermal boundary layer in the liquid, and said firing pulse being applied while the thermal boundary layer is in the liquid and being capable of causing said resistive heating element to produce a vapor bubble in said chamber which causes a resultant droplet of the liquid to be ejected from said chamber orifice, wherein energy diffused in said thermal boundary layer cooperates with energy applied by the firing pulse to increase the size of the thermal boundary layer prior to nucleation and cause the resultant droplet to have a mass of about 20 nanograms to about 40 nanograms and to be ejected from said chamber orifice at a velocity of about 300 inch/s to about 600 inch/s.

40. An apparatus as set forth in claim 39, wherein said cartridge includes a plurality of resistive heating elements and a plurality of liquid-containing chambers having a plurality of orifices.

41. An apparatus as set forth in claims 40, wherein said cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of liquid-containing chambers, and said plurality of resistive heating elements are positioned on said heater chip such that each of said liquid-containing chambers has one of said heating elements located therein.

42. An apparatus for generating liquid droplets having a plurality of colors comprising:

a cartridge including at least one resistive heating element in at least one chamber capable of containing liquid and having an orifice; and a driver circuit, electrically coupled to said cartridge, for applying to said resistive heating element a warming pulse and a firing pulse separated from one another by a delay period, said warming pulse being capable of causing said resistive heating element to warm a portion of liquid provided in the chamber, said warming pulse and said delay period cooperating to form a thermal boundary layer in the liquid, and said firing pulse being applied while the thermal boundary layer is in the liquid and being capable of causing said resistive heating element to produce a vapor bubble in said chamber which causes a resultant droplet of the liquid to be ejected from said chamber orifice, wherein energy diffused in said thermal boundary layer cooperates with energy applied by the firing pulse to increase the size of the thermal boundary layer prior to nucleation and cause the resultant droplet of the liquid to have a mass of about 10 nanograms to about 25 nanograms and to be ejected from said chamber orifice at a velocity of about 400 inch/s to about 700 inch/s.

43. An apparatus as set forth in claim 42, wherein said cartridge includes a plurality of resistive heating elements and a plurality of liquid-containing chambers having a plurality of orifices.

44. An apparatus as set forth in claims 43, wherein said cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of liquid-containing chambers, and said plurality of resistive heating elements are positioned on said heater chip such that each of said liquid-containing chamber has one of said heating elements located therein.

45. A mono ink jet printing apparatus comprising:

a print cartridge including at least one resistive heating element in at least one chamber capable of containing ink and having an orifice; and a driver circuit, electrically coupled to said print cartridge, for applying to said resistive heating element warming and firing pulses separated by a delay period, said warming pulse being capable of causing said resistive heating element to warm a portion of ink provided in the chamber, said warming pulse and said delay period cooperating to form a thermal boundary layer in the ink, and said firing pulse being applied while the thermal boundary layer is in the ink and being capable of causing said resistive heating element to produce a vapor bubble in said chamber which causes a droplet of the ink to be ejected from said chamber orifice, wherein energy diffused in said thermal boundary layer cooperates with energy applied by the firing pulse to increase the size of the thermal boundary layer prior to nucleation and cause said droplet of the mono ink to have a mass of about 20 nanograms to about 40 nanograms and to be ejected from said chamber orifice at a velocity of about 300 inch/s to about 600 inch/s.

46. An ink jet printing apparatus as set forth in claim 45, wherein said print cartridge includes a plurality of resistive heating elements and a plurality of ink-containing chambers having a plurality of orifices.

47. An ink jet printing apparatus as set forth in claim 46, wherein said print cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of ink-containing chambers, and said plurality of resistive heating elements are positioned on said heater chip such that each of said ink-containing chambers has one of said heating elements located therein.

48. An ink jet printing apparatus as set forth in claim 47, wherein said print cartridge further comprises a reservoir filled with ink.

49. An ink printing apparatus as set forth in claim 48, wherein said reservoir is refillable.

50. An ink jet printing apparatus as set forth in claim 45, wherein said delay period is from about 0.5 $\mu$s to about 2.0 $\mu$s.

51. An ink jet printing apparatus as set forth in claim 50, wherein said warming pulse has a pulse width of from about 0.1 $\mu$s to about 0.5 $\mu$s.

52. An ink jet printing apparatus as set forth in claim 51, wherein said firing pulse has a pulse width of from about 1.0 $\mu$s to about 3.0 $\mu$s.

53. A color ink jet printing apparatus comprising:

a print cartridge including at least one resistive heating element in at least one chamber capable of containing ink and having an orifice; and a driver circuit, electrically coupled to said print cartridge, for applying to said resistive heating element warning and firing pulses separated by a delay period, said warming pulse being capable of causing said resistive heating element to warm a portion of ink provided in the chamber, said warming pulse and said delay period cooperating to form a thermal boundary layer in the ink, and said firing pulse being applied while the thermal boundary layer is in the ink and being capable of causing said resistive heating element to produce a vapor bubble in said chamber which causes a droplet of the ink to be ejected from said chamber orifice, wherein energy diffused said thermal boundary layer cooperates with energy applied by the firing pulse to increase the size of the thermal boundary layer prior to nucleation and cause said droplet of the color ink to have a mass of about 10 nanograms to about 25 nanograms and to be ejected from said chamber orifice at a velocity of about 400 inch/s to about 700 inch/s.

54. An ink jet printing apparatus as set forth in claim 53, wherein said print cartridge includes a plurality of resistive heating elements and a plurality of ink-containing chambers having a plurality of orifices.

55. An ink jet printing apparatus as set forth in claim 54, wherein said print cartridge comprises:

a top plate having a plurality of openings formed therein which define said orifices; and a heater chip having said plurality of resistive heating elements formed thereon, said top plate being coupled to said heater chip such that sections of said top plate and portions of said heater chip define said plurality of ink-containing chambers, and said plurality of resistive heating elements are positioned on said heater chip such that each of said ink-containing chambers has one of said heating elements located therein.

56. An ink jet printing apparatus as set forth in claim 53, wherein said delay period is from about 0.5 $\mu$s to about 2.0 $\mu$s.

57. An ink jet printing apparatus as set forth in claim 56, wherein said warming pulse has a pulse width of from about 0.1 $\mu$s to about 0.5 $\mu$s.

58. An ink jet printing apparatus as set forth in claim 57, wherein said firing pulse has a pulse width of from about 1.0 $\mu$s to about 3.0 $\mu$s.

59. An ink jet printing apparatus comprising:

a print cartridge including at least one resistive heating element in at least one chamber capable of containing ink and having an orifice; and a driver circuit, electrically coupled to said print cartridge, for applying to said resistive heating element a single warming pulse and a firing pulse separated from one another by a delay period, said warming pulse being capable of causing said resistive heating element to warm a portion of ink provided in the chamber, said single warming pulse and said delay period cooperating to form a thermal boundary layer in the ink, and said firing pulse being applied while the thermal boundary layer is in the ink and being capable of causing said resistive heating element to produce a vapor bubble in said chamber which causes a resultant droplet of the ink to be ejected from said chamber orifice with a momentum, wherein energy diffused in said thermal boundary layer cooperate with energy applied by the firing pulse to increase the size of the thermal boundary layer prior to nucleation and thereby increase the momentum of said resultant droplet when compared with a droplet resulting when said resistive heating element receives a single firing pulse which applies an energy amount substantially equal to a combined energy amount of said warning pulse and said firing pulse.

60. An apparatus for generating liquid droplets comprising:

a cartridge including at least one resistive heating element in at least one chamber capable of containing liquid and having an orifice; and a driver circuit, electrically coupled to said cartridge, for applying to said resistive heating element a single warming pulse and a firing pulse separated from one another by a delay period, said warming pulse being capable of causing said resistive heating element to warm a portion of liquid provided in the chamber, said single warming pulse and said delay period cooperating to form a thermal boundary layer in the liquid, and said firing pulse being applied while the thermal boundary layer is in the liquid and being capable of causing said resistive heating element to produce a vapor bubble in said chamber which causes a resultant droplet of the liquid to be ejected from said chamber orifice with a momentum, wherein energy diffused in said thermal boundary layer cooperates with energy applied by the firing pulse to increase the size of the thermal boundary layer prior to nucleation and thereby increase the momentum of said resultant droplet when compared with a droplet resulting when said resistive heating element receives a single firing pulse which applies an energy amount substantially equal to a combined energy amount of said warming pulse and said firing pulse.

61. A method of ejecting a droplet of liquid from an orifice of a chamber containing the liquid, said method comprising the steps of:

heating a portion of said liquid in said liquid-containing chamber to a temperature which is below a superheat limit of said liquid by passing a single warming pulse through said resistive heating element;

forming a thermal boundary layer in the liquid; and producing a vapor bubble in said chamber to eject a resultant droplet of the liquid with a momentum from said orifice by passing a firing pulse through said resistive heating element while the thermal boundary layer is in the liquid, wherein energy diffused in said thermal boundary layer cooperates with energy applied by the firing pulse to increase the size of the thermal boundary layer prior to nucleation and thereby increase the momentum of said resultant droplet when compared with a droplet resulting when said resistive heating element receives a single firing pulse which applies an energy amount substantially equal to a combined energy amount of said warming pulse and said firing pulse.

62. A method as set forth in claim 61, wherein the step of forming a thermal boundary layer in the liquid comprises separating the warming pulse and the firing pulse by a delay period.

63. An ink jet printing apparatus comprising:

a print cartridge including at least one resistive heating element in at least one chamber capable of containing ink and having an orifice; and a driver circuit, electrically coupled to said print cartridge, for applying to said resistive heating element a warming pulse and a firing pulse separated from one another by a delay period, said warming pulse applying an amount of energy less than an amount of energy applied by the firing pulse, said warming pulse being capable of causing said resistive heating element to warm a portion of ink provided in the chamber, said warming pulse and said delay period cooperating to form a thermal boundary layer in the ink, and said firing pulse being capable of causing said resistive heating element to produce a vapor bubble in said chamber which causes a resultant droplet of the ink to be ejected from said chamber orifice with a momentum, wherein said warming pulse and said firing pulse result in said at least one resistive heating element receiving an energy density of from about 3000 $J/m^2$ to about 5000 $J/m^2$, and a power density greater that about 2 $GW/m^2$, and wherein said thermal boundary layer cooperates with firing pulse to increase the momentum of said resultant droplet when compared with a droplet resulting when said resistive heating element receives a single firing pulse which applies an energy amount substantially equal to a combined energy amount of said warming pulse and said firing pulse.

64. A method of ejecting a droplet of liquid from an orifice of a chamber containing the liquid, said method comprising the steps of:

heating a portion of said liquid in said chamber to a temperature which is below a superheat limit of said liquid by passing a warming pulse through a resistive heating element;

forming a thermal boundary layer in the liquid; and producing a vapor bubble in said chamber to eject a resultant droplet of the liquid with a momentum from said orifice by passing a firing pulse through said resistive heating element, said thermal boundary layer cooperating with the firing pulse to increase when momentum of said resultant droplet when compared with a droplet resulting when said resistive heating element receives a single firing pulse which applies an energy amount substantially equal to a combined energy amount of said warming pulse and said firing pulse, and said warming pulse applying an amount of energy less than an amount of energy applied by the firing pulse, wherein said warming and firing pulses generated during said heating and producing steps result in said resistive heating element receiving an energy density of from about 3000 $J/m^2$ to about 5000 $J/m^2$, and a power density greater than about 2 $GW/m^2$.

* * * * *

UNITED STATES PATENT AND TRADEMARK OFFICE

CERTIFICATE OF CORRECTION

PATENT NO. : 6,296,350 B1
DATED : October 2, 2001
INVENTOR(S) : Robert W. Cornell et al.

It is certified that error appears in the above-identified patent and that said Letters Patent is hereby corrected as shown below:

Column 12,
Line 55, replace “Layer” with -- layer --.

Column 13,
Line 7, replace “jet” with -- just --.

Column 15,
Line 63, replace “warning” with -- warming --.

Column 16,
Line 7, insert -- in -- between “diffused” and “said”
Line 66, replace “warning” with -- warming --.

Column 18,
Line 42, replace “when” with -- the --.

Signed and Sealed this

Twenty-eighth Day of September, 2004

JON W. DUDAS
*Director of the United States Patent and Trademark Office*